US009909366B1

(12) United States Patent
Cooley et al.

(10) Patent No.: US 9,909,366 B1
(45) Date of Patent: Mar. 6, 2018

(54) CUTTING ELEMENT APPARATUSES AND DRILL BITS SO EQUIPPED

(71) Applicant: US Synthetic Corporation, Orem, UT (US)

(72) Inventors: Craig H. Cooley, Saratoga Springs, UT (US); Timothy N. Sexton, Santaquin, UT (US); David P. Miess, Highland, UT (US); Jeffrey B. Lund, Cottonwood Heights, UT (US)

(73) Assignee: US Synthetic Corporation, Orem, UT (US)

( * ) Notice: Subject to any disclaimer, the term of this patent is extended or adjusted under 35 U.S.C. 154(b) by 260 days.

(21) Appl. No.: 14/755,975

(22) Filed: Jun. 30, 2015

Related U.S. Application Data

(60) Continuation of application No. 13/965,851, filed on Aug. 13, 2013, now Pat. No. 9,091,132, which is a continuation of application No. 13/082,267, filed on Apr. 7, 2011, now Pat. No. 8,528,670, which is a division of application No. 12/134,489, filed on Jun. 6, 2008, now Pat. No. 7,942,218, which is a continuation-in-part of application No. 11/148,806, filed on Jun. 9, 2005, now Pat. No. 7,533,739.

(51) Int. Cl.

| | |
|---|---|
| ***E21B 10/567*** | (2006.01) |
| ***E21B 10/55*** | (2006.01) |
| ***E21B 10/42*** | (2006.01) |
| ***E21B 10/633*** | (2006.01) |
| *E21B 10/56* | (2006.01) |
| *E21B 10/62* | (2006.01) |

(52) U.S. Cl.
CPC ..... *E21B 10/5673* (2013.01); *E21B 10/42* (2013.01); *E21B 10/55* (2013.01); *E21B 10/633* (2013.01); *E21B 2010/562* (2013.01); *E21B 2010/624* (2013.01)

(58) Field of Classification Search
CPC .... E21B 10/5673; E21B 10/633; E21B 10/55; E21B 10/42; E21B 2010/624; E21B 2010/562
See application file for complete search history.

(56) References Cited

U.S. PATENT DOCUMENTS

| | | | |
|---|---|---|---|
| 2,506,341 | A | 5/1950 | Bullock |
| 2,631,360 | A | 3/1953 | Sanford et al. |

(Continued)

OTHER PUBLICATIONS

Dictionary definition of "bond" accessed on Dec. 7, 2012 via dictionary.com.

(Continued)

*Primary Examiner* — Blake E Michener
(74) *Attorney, Agent, or Firm* — Holland & Hart

(57) ABSTRACT

A cutting element assembly for use on a rotary drill bit for forming a borehole in a subterranean formation. A cutting element assembly includes a cutting element having a substrate. The cutting element assembly additionally includes a superabrasive material bonded to the substrate. The substrate extends from an end surface to a back surface. A base member is also coupled to the back surface of the substrate. Additionally, a recess is defined in the base member and a structural element is coupled to the base member. The cutting element assembly also includes a biasing element configured to selectively bias the structural element.

19 Claims, 20 Drawing Sheets

(56) References Cited

U.S. PATENT DOCUMENTS

| | | | | |
|---|---|---|---|---|
| 2,710,180 | A | 6/1955 | Graham | |
| 2,917,819 | A | 12/1959 | Britton et al. | |
| 3,136,615 | A | 6/1964 | Bovenkerk et al. | |
| 3,141,746 | A | 7/1964 | De Lai | |
| 3,175,260 | A | 3/1965 | Bridwell et al. | |
| 3,271,080 | A | 9/1966 | Gowanlock | |
| 3,397,012 | A | 8/1968 | Krekeler | |
| 3,459,073 | A | 8/1969 | Conover | |
| 3,690,728 | A | 9/1972 | Krekeler | |
| 3,693,736 | A | 9/1972 | Gardner | |
| 3,749,190 | A | 7/1973 | Shipman | |
| 3,796,464 | A | 3/1974 | Hansen et al. | |
| 3,820,848 | A | 6/1974 | Kniff | |
| 4,014,395 | A | 3/1977 | Pearson | |
| 4,047,583 | A | 9/1977 | Dyer | |
| 4,057,884 | A | 11/1977 | Suzuki | |
| 4,076,318 | A | 2/1978 | Hauschopp et al. | |
| 4,156,329 | A | 5/1979 | Daniels et al. | |
| 4,199,035 | A | 4/1980 | Thompson | |
| 4,200,159 | A | 4/1980 | Peschel et al. | |
| 4,201,421 | A | 5/1980 | Den Besten et al. | |
| 4,334,585 | A | 6/1982 | Upton | |
| 4,337,980 | A | 7/1982 | Krekeler | |
| 4,453,605 | A | 6/1984 | Short, Jr. | |
| 4,466,498 | A | 8/1984 | Bardwell | |
| 4,478,298 | A | 10/1984 | Hake et al. | |
| 4,511,006 | A | 4/1985 | Grainger | |
| 4,538,690 | A | 9/1985 | Short | |
| 4,553,615 | A | 11/1985 | Grainger | |
| 4,604,106 | A | 8/1986 | Hall | |
| 4,654,947 | A | 4/1987 | Davis | |
| 4,694,918 | A | 9/1987 | Hall et al. | |
| 4,751,972 | A | 6/1988 | Jones et al. | |
| 4,756,631 | A | 7/1988 | Jones | |
| 4,782,903 | A | 11/1988 | Strange | |
| 4,802,539 | A | 2/1989 | Hall et al. | |
| 4,804,231 | A | 2/1989 | Buljan et al. | |
| 4,877,096 | A | 10/1989 | Tibbitts | |
| 4,984,642 | A * | 1/1991 | Renard | E21B 10/5673 175/430 |
| 5,007,493 | A | 4/1991 | Coolidge et al. | |
| 5,007,685 | A | 4/1991 | Beach et al. | |
| 5,056,382 | A | 10/1991 | Clench | |
| 5,172,778 | A * | 12/1992 | Tibbitts | E21B 10/5673 175/420.1 |
| 5,248,006 | A | 9/1993 | Scott | |
| 5,279,375 | A | 1/1994 | Tibbitts | |
| 5,332,051 | A | 7/1994 | Knowlton | |
| 5,348,108 | A | 9/1994 | Scott et al. | |
| 5,351,772 | A | 10/1994 | Smith | |
| 5,431,239 | A | 7/1995 | Tibbitts et al. | |
| 5,469,927 | A | 11/1995 | Griffin | |
| 5,558,170 | A | 9/1996 | Thigpen et al. | |
| 5,678,645 | A | 10/1997 | Tibbitts et al. | |
| 5,737,980 | A | 4/1998 | Keith et al. | |
| 5,788,001 | A * | 8/1998 | Matthias | E21B 10/5735 175/432 |
| 5,810,103 | A | 9/1998 | Torbet | |
| 5,906,245 | A | 5/1999 | Tibbitts et al. | |
| 5,975,811 | A | 11/1999 | Briese et al. | |
| 6,045,440 | A * | 4/2000 | Johnson | E21B 10/5673 175/432 |
| 6,098,729 | A | 8/2000 | Matthias | |
| 6,196,340 | B1 * | 3/2001 | Jensen | E21B 10/52 175/431 |
| 6,283,234 | B1 | 9/2001 | Torbet | |
| 6,302,224 | B1 | 10/2001 | Sherwood, Jr. | |
| 6,408,959 | B2 | 6/2002 | Bertagnolli | |
| 7,389,834 | B1 | 6/2008 | Kembaiyan | |
| 7,410,221 | B2 | 8/2008 | Hall et al. | |
| 7,533,739 | B2 | 5/2009 | Cooley et al. | |
| 7,647,993 | B2 | 1/2010 | Middlemiss | |
| 7,669,674 | B2 | 3/2010 | Hall et al. | |
| 7,762,359 | B1 | 7/2010 | Miess | |
| 8,079,431 | B1 | 12/2011 | Cooley et al. | |
| 8,360,176 | B2 | 1/2013 | Zhang et al. | |
| 8,439,137 | B1 | 5/2013 | Galloway | |
| 2001/0008190 | A1 | 7/2001 | Scott et al. | |
| 2004/0026132 | A1 | 2/2004 | Hall et al. | |
| 2005/0072601 | A1 | 4/2005 | Griffo et al. | |
| 2005/0087371 | A1 | 4/2005 | Kembaiyan | |
| 2005/0103533 | A1 | 5/2005 | Sherwood et al. | |
| 2006/0144621 | A1 | 7/2006 | Tank et al. | |
| 2006/0180354 | A1 | 8/2006 | Belnap et al. | |
| 2006/0278441 | A1 | 12/2006 | Cooley et al. | |
| 2007/0056776 | A1 | 3/2007 | Overstreet | |
| 2007/0079991 | A1 | 4/2007 | Cooley et al. | |
| 2007/0278017 | A1 | 12/2007 | Shen et al. | |
| 2008/0017419 | A1 | 1/2008 | Cooley et al. | |
| 2008/0073125 | A1 | 3/2008 | Eason et al. | |
| 2008/0085407 | A1 | 4/2008 | Cooley et al. | |
| 2009/0173548 | A1 | 7/2009 | Voronin et al. | |
| 2010/0051352 | A1 | 3/2010 | Prevost | |
| 2014/0366456 | A1 * | 12/2014 | Chapman | E21B 10/46 51/307 |

OTHER PUBLICATIONS

Oil and Gass Well Drilling and Servicing eTool (www.osha.gov), 2011.

Encyclpedia entry for "brazing", accessed Jul. 29, 2014 via the freedicitionary.com.

Dictionary definition of "adhered" and "coating", accessed Apr. 4, 2014 via thefreedictionary.com.

* cited by examiner

CUTTING ELEMENT APPARATUSES AND DRILL BITS SO EQUIPPED

CROSS REFERENCE TO RELATED APPLICATION

This application is a Continuation of U.S. patent application Ser. No. 13/965,851, filed 13 Aug. 2013, which is a Continuation of U.S. patent application Ser. No. 13/082,267, filed 7 Apr. 2011, now U.S. Pat. No. 8,528,670, issued on 10 Sep. 2013, which is a Divisional of U.S. application Ser. No. 12/134,489, filed 6 Jun. 2008, now U.S. Pat. No. 7,942,218, issued 17 May 2011, which is a Continuation-in-Part of U.S. application Ser. No. 11/148,806, filed 9 Jun. 2005, now U.S. Pat. No. 7,533,739, issued 19 May 2009, the disclosures of which are incorporated, in their entirety, by this reference.

BACKGROUND OF THE INVENTION

Field of the Invention

The present invention relates generally to rotary drill bits for drilling subterranean formations, and more specifically to retention of cutting element apparatuses for use with rotary drill bits for drilling subterranean formations.

State of the Art

Rotary drill bits employing polycrystalline diamond compact ("PDC") cutters have been employed for drilling subterranean formations for a relatively long time. PDC cutters comprised of a diamond table formed under ultra high temperature, ultra high pressure conditions onto a substrate, typically of cemented tungsten carbide (WC), were introduced about twenty five years ago. As known in the art, drill bit bodies may comprise a so-called tungsten carbide matrix including tungsten carbide particles distributed within a binder material or may comprise steel. Tungsten carbide matrix drill bit bodies are typically fabricated by preparing a mold that embodies the inverse of the desired generally radially extending blades, cutting element sockets or pockets, junk slots, internal watercourses and passages for delivery of drilling fluid to the bit face, ridges, lands, and other external topographic features of the drill bit. Then, particulate tungsten carbide is placed into the mold and a binder material, such as a metal including copper and tin, is melted into the tungsten carbide particulate and solidified to form the drill bit body. Steel drill bit bodies are typically fabricated by machining a piece of steel to form generally radially extending blades, cutting element sockets or pockets, junk slots, internal watercourses and passages for delivery of drilling fluid to the bit face, ridges, lands, and other external topographic features of the drill bit. In both matrix-type and steel bodied drill bits, a threaded pin connection may be formed for securing the drill bit body to the drive shaft of a downhole motor or directly to drill collars at the distal end of a drill string rotated at the surface by a rotary table or top drive.

Conventional cutting element retention systems or structures that are currently employed generally comprise the following two styles: (1) tungsten carbide studs comprising a cylindrical tungsten carbide cylinder having a face oriented at an angle (back rake angle) with respect to the longitudinal axis of the cylinder, the face carrying a superabrasive cutting structure thereon, wherein the cylinder is press-fit into a recess that is generally oriented perpendicularly to the blades extending from the bit body on the bit face; and (2) brazed attachment of a generally cylindrical cutting element into a recess formed on the bit face, typically on a blade extending from the bit face. Accordingly, the first cutting element retention style is designed for a stud type cutting element, while the second cutting element retention style is designed for generally cylindrical cutting elements, such as PDC cutters. In either system, the goals are to provide sufficient cutting element attachment and retention as well as mechanical strength sufficient to withstand the forces experienced during the drilling operation. Of the two different types of cutting element retention configurations utilized in the manufacture of rotary drill bits, cylindrical cutting elements are generally more common. Stud-type cutting elements, on the other hand, are relatively uncommon and may require a brazing or infiltration cycle to affix the PDC or TSPs to the stud. Examples of other conventional cutting element attachment configurations include, inter alia, U.S. Pat. No. 6,283,234 to Torbet, U.S. Pat. No. 5,906,245 to Tibbitts, U.S. Pat. No. 5,558,170 to Thigpen et al., U.S. Pat. No. 4,782,903 to Strange, and U.S. Pat. No. 4,453,605 to Short.

Therefore, it would be advantageous to provide a cutting element retention configuration for use in rotary drill bits that ameliorates the disadvantages of conventional cutting element retention configurations. Further, it would be advantageous to provide a cutting element mechanism or apparatus that provides for ease of replacement or flexibility of design. Also, it may be advantageous to provide a cutting element retention mechanism and method that avoids directly brazing the cutting element to a drill bit.

SUMMARY OF THE INVENTION

One aspect of the present invention relates to a cutting element assembly for use on a rotary drill bit for forming a borehole in a subterranean formation. Particularly, a cutting element assembly according to the present invention may comprise a cutting element comprising a substrate having a layer of superabrasive material disposed on an end surface thereof, the substrate extending from the end surface to a back surface thereof and a base member affixed to the back surface of the substrate, wherein the base member includes a recess configured to secure the base member to a rotary drill bit. The present invention also contemplates various aspects that a base member may exhibit. For example, in one embodiment, at least a portion of an exterior of the base member may be tapered (e.g., substantially frustoconical). In another embodiment, a base member may be substantially cylindrical. Further, a structural element may be coupled to the recess of the base member. Optionally, an inner member may be positioned within the recess of the base member. As a further option, a structural element may be coupled to the inner member.

Another aspect of the present invention relates to a rotary drill bit for drilling a subterranean formation, wherein the rotary drill bit includes a cutting element assembly according to the present invention. Particularly, a cutting element assembly may be coupled to a bit body of a rotary drill bit. In one aspect of the present invention, a structural element may be structured for generating a force on the base member in a direction substantially perpendicular to a cutting-face of the cutting element. Thus, in one embodiment, a force may be applied to the base member to bias the base member into a recess formed in the bit body.

A further aspect of the present invention relates to a method of securing a cutting element to a rotary drill bit for drilling a subterranean formation. Specifically, a cutting element assembly may be provided including a cutting element comprising a substrate including a layer of superabrasive material disposed on an end surface of the substrate and a base member affixed to a back surface of the substrate. Further, the base member may be positioned within the recess formed in the bit body and a force may be applied to the base member to bias the base member into the recess formed in the bit body.

Another aspect of the invention relates to a cutting element assembly for use on a rotary drill bit for forming a borehole in a subterranean formation. Particularly, the cutting element assembly may comprise a cutting element having a substrate. The cutting element assembly may additionally comprise a superabrasive material bonded to the substrate, with the substrate extending from an end surface to a back surface. A base member may also be coupled to the back surface of the substrate. Additionally, a recess may be defined in the base member. Further, a structural element may be coupled to the base member. The cutting element assembly may also comprise a biasing element configured to selectively bias the structural element.

An additional aspect of the invention relates to a cutting element assembly for use on a rotary drill bit for forming a borehole in a subterranean formation. Specifically, the cutting element assembly may comprise a cutting element comprising a substrate. The cutting element assembly may additionally comprise a superabrasive material bonded to the substrate, with the substrate extending from an end surface to a back surface of the substrate. An intermediate base member may also be coupled to the back surface of the substrate, with the intermediate base member extending from a surface adjacent the back surface of the substrate to a back surface of the intermediate base member. Further, a terminal base member may be coupled to the back surface of the intermediate base member. Additionally, a recess may be defined in the terminal base member and may be configured to secure the terminal base member to a rotary drill bit.

A further aspect of the invention relates to a cutting element assembly for use on a rotary drill bit for forming a borehole in a subterranean formation. In particular, the cutting element assembly may comprise a cutting element comprising a substrate. The cutting element assembly may additionally comprise a superabrasive material bonded to the substrate, with the substrate extending from an end surface to a back surface. Additionally, the cutting element assembly may comprise a base member coupled to the back surface of the substrate. A threaded recess may be defined in the base member.

Another aspect of the invention relates to a rotary drill bit comprising a bit body for drilling a subterranean formation. The bit body may comprise a cutting pocket defined in an exterior surface of the bit body. Additionally, the bit body may comprise a cutting element assembly positioned at least partially in the cutting pocket. The cutting element assembly may comprise a cutting element comprising a substrate. The cutting element assembly may additionally comprise a superabrasive material bonded to the substrate, with the substrate extending from an end surface to a back surface. The cutting element assembly may also comprise a base member affixed to a back surface of the substrate. Further, the cutting element assembly may comprise a coupling recess defined in the base member. Additionally, a structural element may be coupled to the based member.

Features from any of the above-mentioned embodiments may be used in combination with one another in accordance with the present invention. In addition, other features and advantages of the present invention will become apparent to those of ordinary skill in the art through consideration of the ensuing description, the accompanying drawings, and the appended claims.

DETAILED DESCRIPTION OF THE INVENTION

Generally, the present invention relates to a retention structure for securing a cutting element to a rotary drill bit for drilling a subterranean formation. In further detail, the present invention relates to a cutting element having a base member affixed to a back surface opposite of the cutting-face of the cutting element. The base member includes an aperture for facilitating retention of a cutting element. The aperture may be configured for accepting a fastening or support element, wherein the fastening element extends from the aperture and may facilitate affixation, support, or securement of the cutting element to a rotary drill bit.

Figure 1:
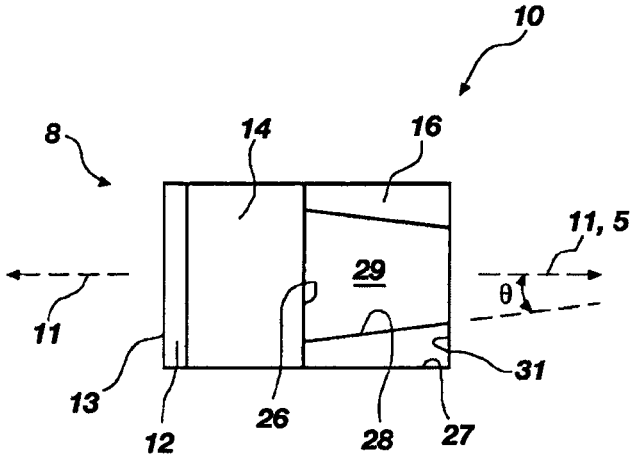
FIG. 1 shows a schematic side cross-sectional view of one embodiment of a cutting element assembly according to the present invention.

For example, FIG. 1 shows a side cross-sectional view of one embodiment of a cutting element assembly 10 according to the present invention. In further detail, a cutting element 8 may include a table 12 affixed to or formed upon a substrate 14. Cutting element 8 may comprise any cutting element of a type known in the art for drilling into a subterranean formation (e.g., a PDC cutter), without limitation. Typically, a layer or table 12 may be formed of a superhard or superabrasive material such as, for example, polycrystalline diamond. For example, cutting element 8 may include a table 12 comprising polycrystalline diamond while substrate 14 may comprise a cobalt-cemented tungsten carbide substrate. As known in the art, a catalyst material (e.g., cobalt, nickel, etc.) may be at least partially removed (e.g., by acid-leaching) from a table 12 comprising polycrystalline diamond. Cutting table 12 forms a cutting face 13, which is generally perpendicular to a central axis 11. Central axis 11 may be substantially centered (i.e., positioned at a centroid) with respect to a selected cross-sectional area (e.g., a solid cross-sectional area or a cross-sectional area bounded by an exterior surface, without limitation) of cutting element 8. In addition, a base member 16 may be affixed to the back surface 26 of substrate 14. For example, base member 16 may be affixed to the back surface 26 of substrate 14 by way of brazing. As shown in FIG. 1, base member 16 extends from back surface 26 of substrate 14 to back surface 31 of base member 16 and includes a recess 29 defined, at least in part, by interior surface 28. It should be further understood that base member also includes a central axis 5, which may be substantially aligned (substantially parallel and substantially collinear) with the central axis 11 of the cutting element 8. As further shown in FIG. 1, base member 16 may form a sleeve or tubular element wherein recess 29 exhibits a cross-sectional size that decreases with distance from back surface 26 of cutting element 8. Further, in one embodiment, base member 16 may be radially symmetric with respect to central axis 5. Thus, recess 29 may be generally frustoconical, wherein an angle $\theta$ is formed between central axis 11 and interior surface 28. In one embodiment, angle $\theta$ may be about 0° to 15°. Such a configuration may provide a robust structure for affixing the base member 16 to a rotary drill bit body, as discussed hereinbelow in further detail. In one embodiment, base member 16 may comprise cemented tungsten carbide. In such a configuration, base member 16 may be manufactured according to processes as known in the art. Also, such a configuration may provide suitable structural support for cutting element 8 during drilling into a subterranean formation. Optionally, base member 16 may comprise steel or another material suitable for supporting cutting element 8.

Figure 2:
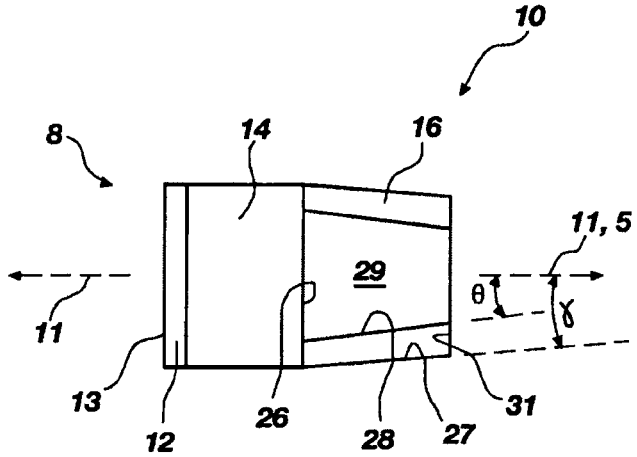
FIG. 2 shows a schematic side cross-sectional view of another embodiment of a cutting element assembly according to the present invention.

As shown in FIG. 1, base member 16 may have an exterior surface 27 that is substantially parallel to central axis 11 of the cutting element. Thus, in one embodiment, base member 16 may be substantially cylindrical. Of course, in other embodiments, exterior surface 27 may be generally rectangular, generally hexagonal, triangular, or any other cross-sectional shape (i.e., taken transverse to central axis 11) as may be desired, without limitation. In another embodiment, FIG. 2 shows a cutting element 8 and a base member 16 wherein the exterior surface 27 of the base member 16 is nonparallel with respect to central axis 11. Put another way, exterior surface 27 of base member 16 may be tapered so that a cross-sectional size thereof decreases with respect to an increasing distance from back surface 26 of cutting element 8. Accordingly, if base member 16, as shown in FIG. 2, is substantially symmetric about central axis 11, base member 16 may be substantially frustoconical, wherein an angle γ is formed between central axis 11 and exterior surface 27. In one embodiment, angle γ may be about 0° to 15°. Such a frustoconical shape may be advantageous for mating within a corresponding recess formed within a rotary drill bit body, as discussed in further detail hereinbelow.

Figure 3:
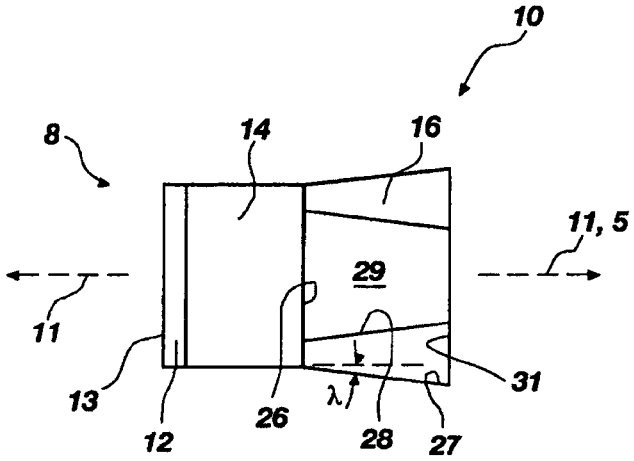
FIG. 3 shows a schematic side cross-sectional view of a further embodiment of a cutting element assembly according to the present invention.

FIG. 3 shows a side cross-sectional view of a further embodiment of a cutting element assembly 10 according to the present invention. Particularly, exterior surface 27 of base member 16 may be tapered so that a cross-sectional size thereof increases with respect to an increasing distance from back surface 26 of cutting element 8. Accordingly, if base member 16 is substantially symmetric about central axis 11, base member 16 may be substantially frustoconical wherein an angle λ is formed between central axis 11 and exterior surface 27. In one embodiment, angle λ may be about 0° to 15°. Such a frustoconical shape may be advantageous for mating within a corresponding recess formed within a rotary drill bit body, as discussed in further detail hereinbelow.

Figure 4:
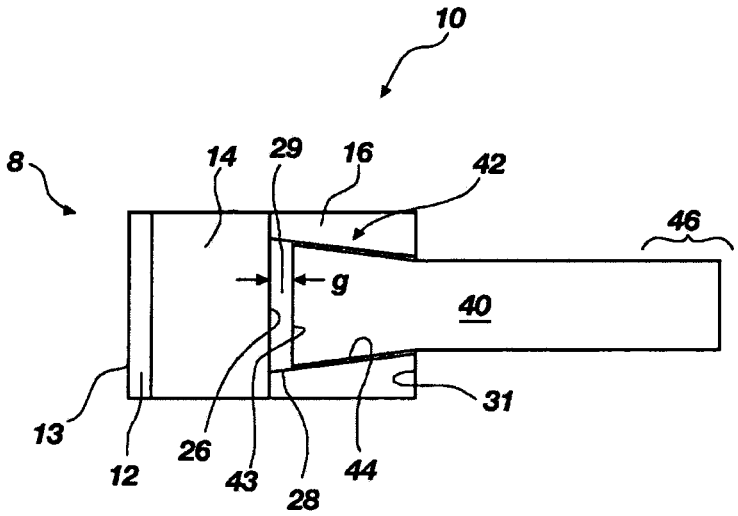
FIG. 4 shows a schematic side cross-sectional view of the cutting element assembly shown in FIG. 1, including a structural element.
Figure 5:
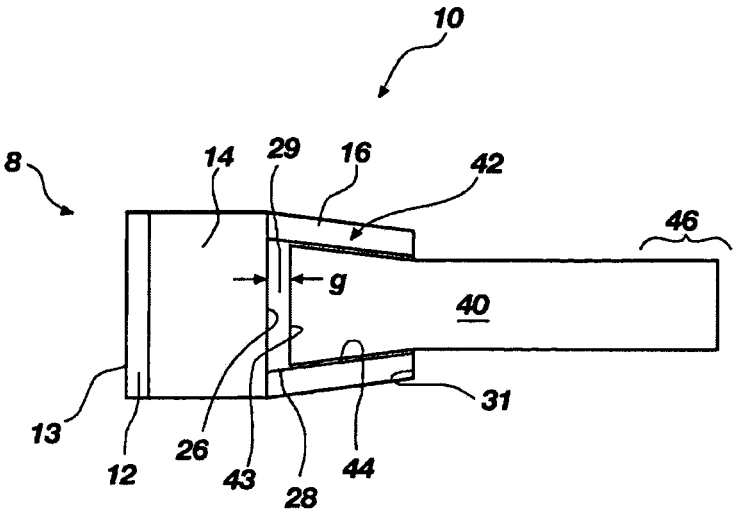
FIG. 5 shows a schematic side cross-sectional view of the cutting element assembly shown in FIG. 2, including a structural element.

The present invention further contemplates, in one embodiment, that a structural element may be employed in combination with the cutting element retention structures or assemblies for securing or supporting a cutting element within a rotary drill bit body. For example, in one embodiment, a structural element may include an enlarged end that is sized and configured for fitting within a recess of a base member. More specifically, FIG. 4 shows a side cross-sectional view of one embodiment of a structural element 40 positioned within recess 29 of base member 16 as shown and described above with respect to FIG. 1. As shown in FIG. 4, structural element 40 includes an enlarged end 42 defined by tapered surface 44, wherein the enlarged end 42 is positioned within recess 29 of base member 16. Structural element 40 may be positioned within recess 29 prior to affixing the base member 16 to the substrate 14. Also, as shown in FIG. 4, structural element 40 may be sized to provide a gap "g" between the back surface 26 of the cutting element 8 and the leading surface 43 of the structural element 40. Further, at least a portion of tapered surface 44 may be substantially congruent (i.e., complimentary or substantially parallel) to at least a portion of interior surface 28 of base member 16. Such a configuration may provide a relatively robust and effective locking mechanism therebetween. Optionally, at least a portion of tapered surface 44 may be affixed to at least a portion of interior surface 28 by way of adhesive, brazing, welding, mechanical fasteners, mechanical affixation, or as otherwise known in the art. Further, structural element 40 may extend from base member 16 and may have an end region 46 structured for facilitating affixation of the cutting element 8 to a rotary drill bit, as discussed in greater detail hereinbelow. In one embodiment, end region 46 of structural element 40 may be threaded to facilitate affixing or securing the cutting element assembly 10 to a rotary drill bit. Similarly, FIG. 5 shows a side cross-sectional view of one embodiment of structural element 40 positioned within recess 29 of a base member 16 as shown and described above with respect to FIG. 2. As described above, structural element 40 may include an enlarged end 42 positioned within recess 29 of base member 16 and, optionally, which may be affixed to one another. Structural element 40 may be positioned within recess 29 prior to affixing the base member 16 to the substrate 14.

Figure 6:
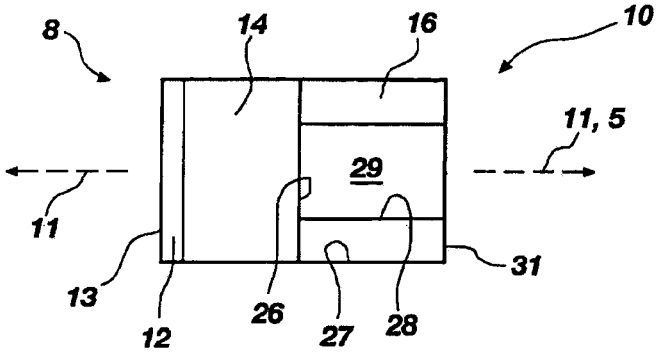
FIGS. 6-12 each show respective schematic side cross-sectional views of different embodiments of a cutting element assembly according to the present invention.
Figure 7:
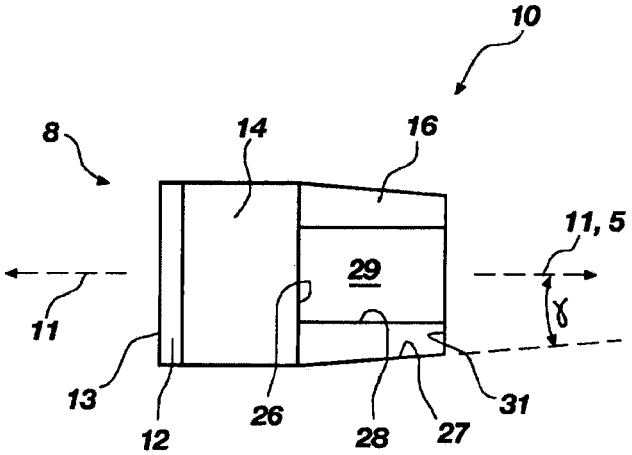
Figure 8:
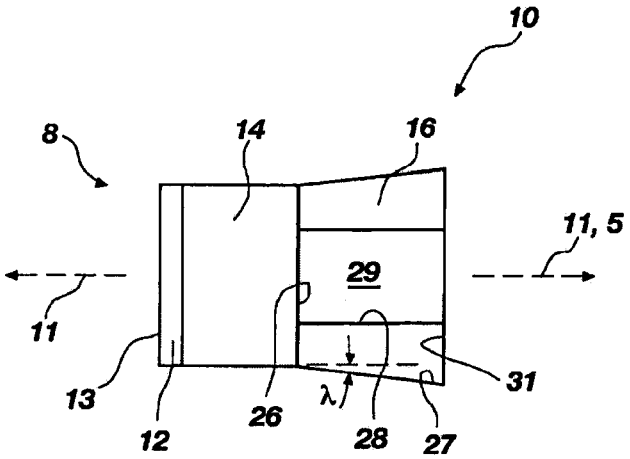

It should be appreciated that the present invention contemplates that variations of the retention structures described hereinabove may be employed. For example, the present invention contemplates that an interior surface of a base member may be substantially parallel with a central axis of the cutting element so that a cross-sectional size of an aperture defined therein may generally remain constant with increasing distance from the back surface of the cutting element to which the base member is affixed. For example, FIG. 6 shows a cutting element assembly 10 generally as described above in relation to FIG. 1, however, both interior surface 28 and exterior surface 27 of base member 16 may be generally parallel to central axis 11. Thus, in one embodiment, an exterior of base member 16 may be substantially cylindrical and recess 29 of base member 16 may be substantially cylindrical. FIG. 7 shows another embodiment of a cutting element assembly 10 which may be generally configured as described with respect to FIG. 6, but wherein exterior surface 27 of base member 16 may be tapered so that a cross-sectional size of the exterior surface 27 decreases with respect to an increasing distance from back surface 26 of cutting element 8. Accordingly, if base member 16 is substantially radially symmetric about central axis 11, base member 16 may be substantially frustoconical wherein an angle γ is formed between central axis 11 and exterior surface 27. FIG. 8 shows another embodiment of a cutting element assembly 10 according to the present invention, which may be configured generally as described with respect to FIG. 6, but may include an interior surface 28 that is generally parallel to central axis 11 and an exterior surface 27 that may be tapered so that a cross-sectional size thereof increases with respect to an increasing distance from back surface 26 of cutting element 8. Accordingly, if base member 16 is substantially radially symmetric about central axis 11, base member 16 may be substantially frustoconical wherein an angle λ is formed between central axis 11 and exterior surface 27.

Figure 9:
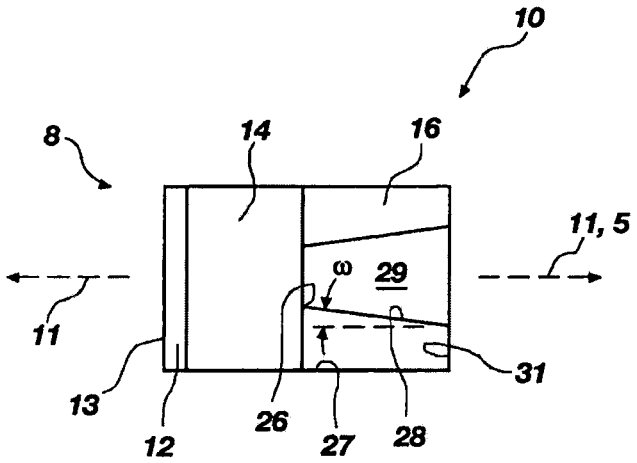
Figure 10:
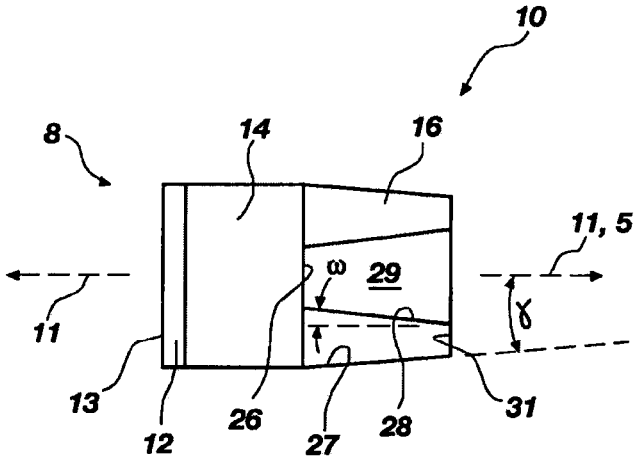
Figure 11:
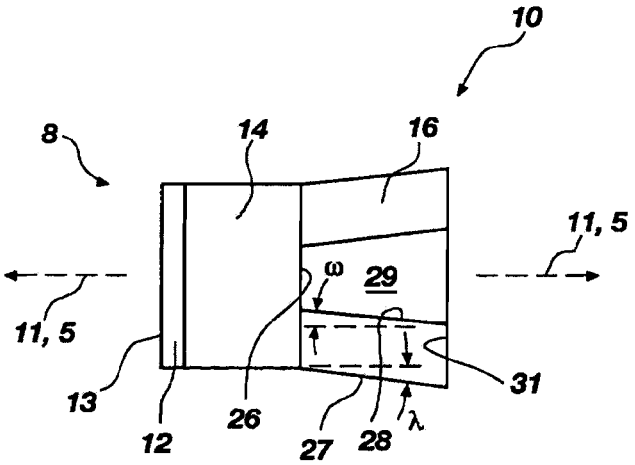

In other embodiments, the present invention contemplates that an interior surface of a base member may be tapered so that a cross-sectional size of an aperture defined by the base may generally increase with increasing distance from the back surface of the cutting element to which the base member is affixed. For example, FIG. 9 shows a side cross-sectional view of a cutting element assembly 10 according to the present invention generally as described above in relation to FIG. 1, however, interior surface 28 tapers such that a cross-sectional size of recess 29 increases with respect to an increasing distance from back surface 26 of cutting element 28. Thus, if base member 16 is substantially radially symmetric about central axis 11, recess 29 of base member 16 may be substantially frustoconical wherein an angle co is formed between central axis 11 and interior surface 28. FIG. 10 shows a side cross-sectional view of a cutting element assembly 10 according to the present invention generally as described above in relation to FIG. 9, however, exterior surface 27 of base member 16 may be tapered so that a cross-sectional size of the base member 16 decreases with respect to an increasing distance from back surface 26 of cutting element 8. Accordingly, if base member 16 is substantially radially symmetric about central axis 11, base member 16 may be substantially frustoconical wherein an angle γ is formed between central axis 11 and exterior surface 27. FIG. 11 shows another embodiment of a assembly 10 according to the present invention, which may be configured generally as described with respect to FIG. 9, but may include an exterior surface 27 that may be tapered so that a cross-sectional size of the base member 16 increases with respect to an increasing distance from back surface 26 of cutting element 8. Accordingly, if base member 16 is substantially radially symmetric about central axis 11, base member 16 may be substantially frustoconical wherein an angle λ is formed between central axis 11 and exterior surface 27.

Figure 12:
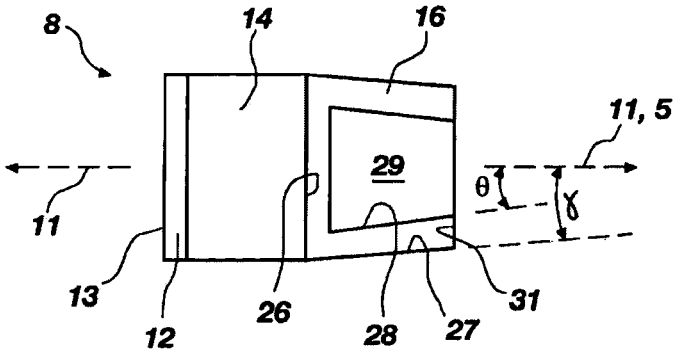
Figure 13:
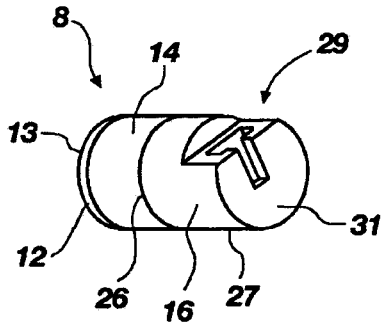
FIGS. 13 and 14 each show a perspective view of a cutting element assembly including a T-slot shaped recess and a dove-tail shaped recess, respectively.
Figure 14:
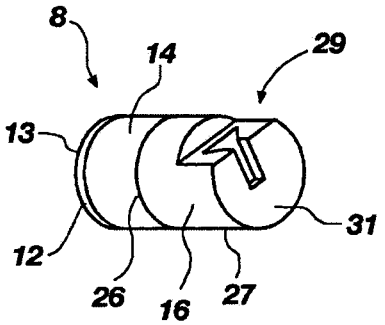

In yet another aspect of the present invention, a recess may be formed that does not extend through the base member. For example, FIG. 12 shows one embodiment wherein recess 29 is formed within, but not completely through, base member 16. Of course, interior surface 28 and exterior surface 27 of base member 16 may be configured as described above with respect to FIGS. 1-3 and 6-11. In other embodiments, a recess (e.g., recess 29) formed in a base member may embody any groove or channel structured for mechanically coupling structures to one another as known in the art. For example, as shown in FIG. 13, a so-called T-slot-shaped recess 29 may be formed within base member 16. It should be understood that a structural element (e.g., 40) may be coupled to recess 29 directly or via a separate member (e.g., an inner member 50 as discussed below) positioned within recess 29 or an end of the structural element that is configured for being positioned within recess 29 to couple the structural element thereto. Similarly, FIG. 14 shows a base member including a so-called dove-tail shaped recess 29. Of course, a structural element (e.g., 40) may be coupled to recess 29 through a separate member (e.g., an inner member 50 as discussed below) positioned within recess 29 or an end of the structural element that is configured for being positioned within recess 29.

Figure 15:
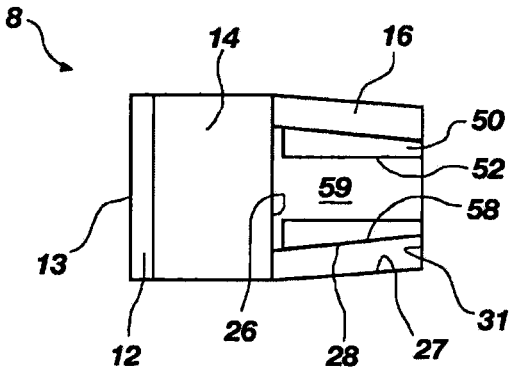
FIG. 15 shows a schematic side cross-sectional view of one embodiment of a cutting element assembly according to the present invention including an inner member positioned within a base member.

In a further aspect of the present invention, an inner member may be positioned within a base element. For example, in one embodiment, FIG. 15 shows a cutting element assembly 10 according to the present invention in a side cross-sectional view. Particularly, a base member 16 may be configured and affixed to cutting element 8. Of course, base member 16 may be configured according to any embodiment as described above with reference to any of FIGS. 1-3 and 6-11. As shown in FIG. 15, inner member 50 is defined by an exterior surface 58 and an interior surface 52, wherein the interior surface 52 defines an aperture 59 extending through the inner member 50. In addition, an inner member 50 may be positioned within base member 16. Further, optionally, inner member 50 may be affixed to base member 16. For example, inner member 50 may be affixed to base member 16 by way of an adhesive, brazing, welding, mechanical affixation, or as otherwise known in the art. Inner member 50 may comprise a material that is more ductile than base member 16. In such a configuration, inner member 50 may be more easily machined or otherwise fabricated than base member 16. In addition, it may be desirable for base member 16 to exhibit a relatively high modulus of elasticity (e.g., 45,000 ksi or more). In one embodiment, base member 16 may exhibit a modulus of elasticity of about 95,000 ksi. to about 105,000 ksi. Such a configuration may allow for suitable mechanical support of cutting element 8 during drilling operations. Inner member 50 may have a modulus of elasticity of about 15,000 ksi up to about 70,000 ksi. Such a modulus of elasticity may provide a level of compliance within a cutting element retention assembly according to the present invention. The present invention contemplates, in one embodiment, that base member 16 may comprise a cemented tungsten carbide, while inner member 50 may comprise a steel alloy (e.g., an AISI 4140 steel alloy, an AISI 1040 steel alloy, an UNS S17400 steel alloy, etc.).

Further, inner member 50 may be structured for facilitating selective securement or removal of a cutting element to or from, respectively, a rotary drill bit by way of a fastening element. More particularly, in one embodiment, the inner surface 52 of inner member 50 may be threaded. In such a configuration, a structural element (e.g., a fastening element) may include a complementarily threaded surface for coupling to the inner surface 52. In another embodiment, inner member 50 may include a so-called bayonet-type locking configuration or other male/female type mechanical interconnection, as known in the art. In such a configuration, a structural element may include features for a so-called bayonet-type locking configuration. In other embodiments, interlocking or interconnecting structures may be formed upon or within inner member 50 and may be structured for mechanically coupling to corresponding interlocking or interconnecting structures formed on a structural element. Thus, generally, the present invention contemplates that inner member 50 may be structured for coupling to a structural element to positively engage or couple therewith. Further, structural element 70 may have an end region 76 structured for facilitating affixation of the cutting element 8 to a rotary drill bit, as discussed in greater detail hereinbelow. In one embodiment, end region 76 of structural element 70 may be threaded to facilitate affixing or securing the cutting element 8 to a rotary drill bit.

Figure 16:
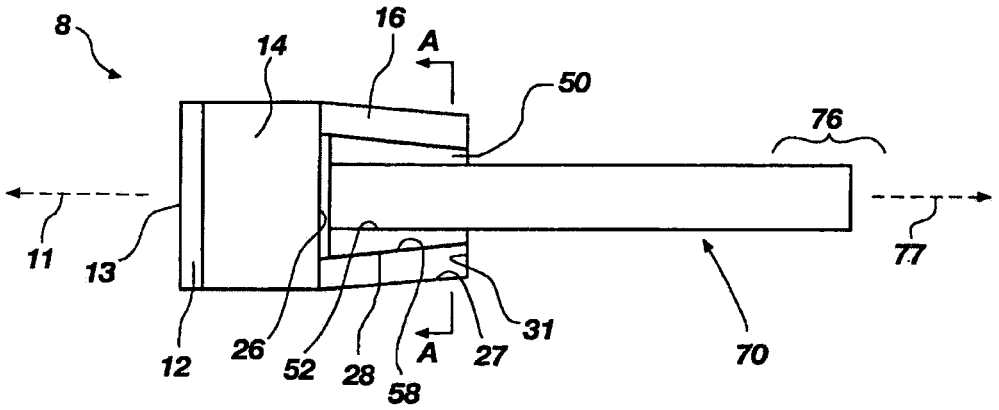
FIG. 16 shows a schematic side cross-sectional view of another embodiment of a cutting element assembly according to the present invention including an inner member positioned within a base member and a structural element coupled to the inner member.
Figure 16B:
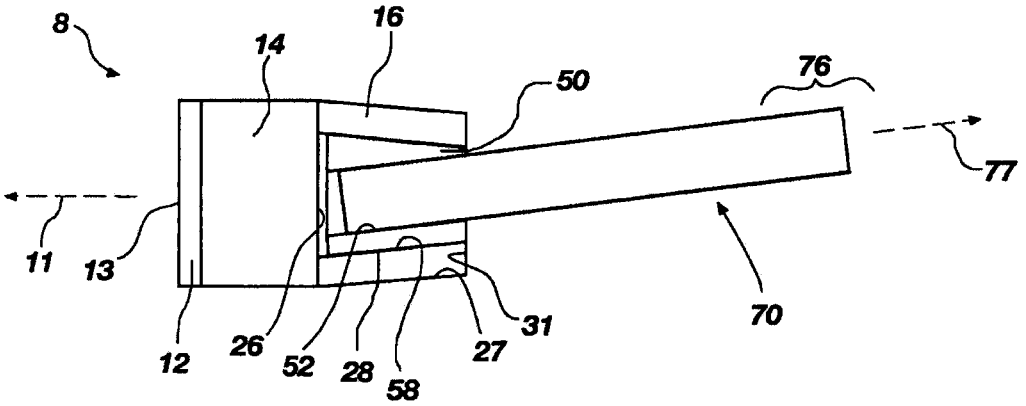
FIG. 16B shows a schematic side cross-sectional view of a further embodiment of a cutting element assembly according to the present invention including an inner member positioned within a base member and a structural element coupled to the inner member.
Figure 16C:
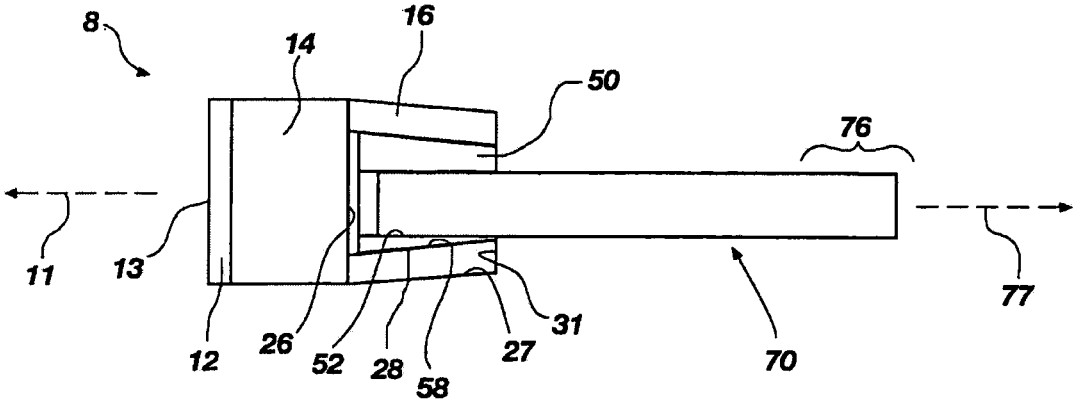
FIG. 16C shows a schematic side cross-sectional view of an additional embodiment of a cutting element assembly according to the present invention including an inner member positioned within a base member and a structural element coupled to the inner member.

More particularly, FIG. 16 shows a schematic side cross-sectional view of the retention assembly shown in FIG. 15 wherein a structural element 70 is positioned within and coupled to inner member 50. Structural element 70 may be mechanically coupled to inner member 50 to prevent longitudinal displacement relative to one another. For example, structural element 70 may be brazed, adhesively affixed, or welded to inner member 50. In another embodiment, inner member 50 may be mechanically coupled to inner member 50 as known in the art (e.g., via a pin, a snap ring, a rivet, etc.). Structural element 70 may extend from base element 16 substantially perpendicularly with respect to central axis 11 of the cutting element 8. However, it should be further appreciated that inner member 50 may be configured so that a structural element 70 extends at an angle, is offset, or is both nonparallel and offset with respect to a central axis 11 of the cutting element 8. For example, FIG. 16B shows a structural element 70 extending along a longitudinal axis 77 that is substantially nonparallel to central axis 11 of cutting element 8. In another embodiment, as shown in FIG. 16C, a structural element 70 extending along a longitudinal axis 77 that is substantially parallel but is not collinear (i.e., offset) with central axis 11 of cutting element 8.

Figure 17:
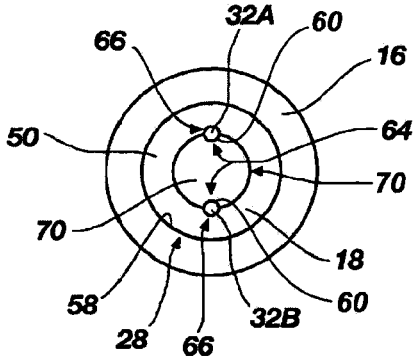
FIG. 17 shows a schematic cross-sectional view of the cutting element assembly shown in FIG. 16.

In another embodiment, structural element 70 may be threaded and the inner surface 52 of inner member 50 may be threaded. In such a configuration, inner member 50 and base member 16 may be structured for preventing relative rotation with respect to one another. Explaining further, preventing relative rotation between inner member 50 and base member 16 may prevent inner member 50 and structural element 70 from becoming loosened. Generally, friction between inner member 50 and base member 16 may prevent relative rotation therebetween. In another embodiment, inner member 50 and base member 16 may be affixed to one another or otherwise configured to inhibit relative rotation therebetween. Further, inner member 50 and structural element 70 may include recesses that may be aligned to form passageways for accepting locking elements. For example, FIG. 17 shows an enlarged schematic end view taken transverse to central axis 11, wherein locking elements 32A and 32B are positioned within each of passageways 60 formed by recesses 64 and recesses 66, respectively. Such a configuration may resist relative rotation of structural element 70 with respect to inner member 50. Of course, other locking mechanisms are contemplated by the present invention such as, for example, mechanically or adhesively coupling inner member 50 and base member 16, or any locking or self-locking fastener as known in the art. For example, locking or self-locking fasteners may be commercially available from Long-Lok Fasteners Corporation of Hawthorne, Calif.

Figure 18:
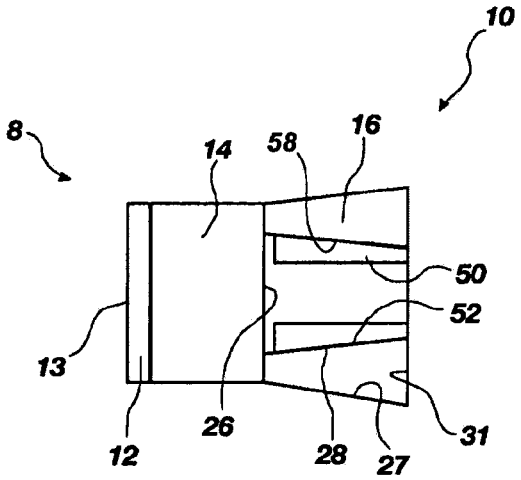
FIGS. 18 and 19 each show respective schematic side cross-sectional views of different embodiments a cutting element assembly including an inner member according to the present invention.
Figure 19:
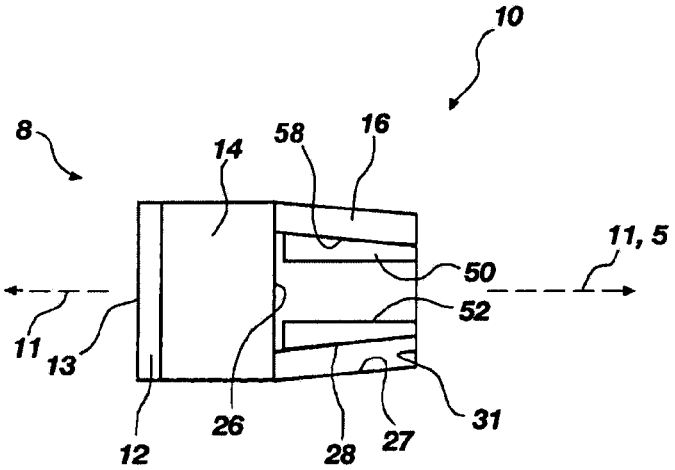

It should be understood that any of the above-described embodiments of base member 16 may be employed in combination with an inner member 50. Thus, while FIGS. 18 and 19 show embodiments of base members 16 as shown in FIGS. 3 and 2, respectively, including an inner member 50 positioned within recess 29, an inner member 50 may be configured for use in combination with any base member 16 contemplated by the present invention. If, for instance, a base member has an interior surface 28 that is substantially parallel to a central axis of the cutting element to which it is attached, an inner member may be press-fit, brazed, or otherwise mechanically affixed to the base member. In addition, it should be understood that an inner member may be structured for applying a force generally toward a cutting-face of a cutting element if so desired. Thus, as may be appreciated by the varied embodiments and aspects of the present invention, different structural aspects of base member 16 may afford various advantages and features with respect to securing a cutting element 8 to a rotary drill bit for subterranean drilling.

Thus, the present invention relates to structures for affixing cutting elements to a rotary drill bit for subterranean drilling. As used herein, the term "drill bit" includes and encompasses core bits, roller-cone bits, fixed-cutter bits, eccentric bits, bicenter bits, reamers, reamer wings, or other earth-boring tools as known in the art. Generally, the present invention contemplates that a recess formed in a base member may be employed for mechanically coupling a cutting element to a rotary drill bit. Conventionally, cutting elements are typically brazed within a rotary drill bit. Accordingly, one advantage of the present invention may relate to mechanically coupling a cutting element to a rotary drill bit without brazing the cutting element thereto. Such mechanical coupling of a cutting element to a rotary drill bit may avoid thermal damage and the processes accompanying brazing a cutting element to a rotary drill bit.

Figure 20:
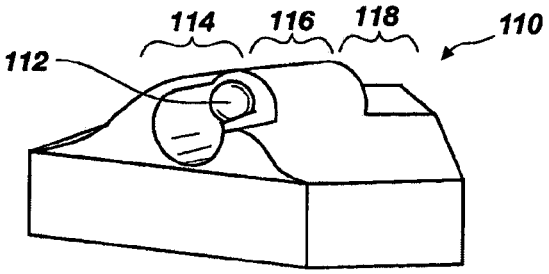
FIG. 20 shows a partial perspective view of a bit blade including a recess for accepting a cutting element assembly according to the present invention.

FIG. 20 shows a partial perspective view of one embodiment of a bit blade 110 having a recess 112 formed therein sized and configured to accept a base element affixed to a cutting element (e.g., a PDC cutter). In addition, FIG. 20 shows a cutting pocket portion 114 of bit blade 110, a support portion 116 of bit blade 110, and an anchor portion 118 of bit blade 110. Cutting pocket portion 114 of bit blade 110 may be generally configured for surrounding at least a portion of a cutting element positioned therein and may inhibit erosion of a substrate of such a cutting element (e.g., a PDC cutter) due to flow of drilling fluid. Support portion 116 of bit blade 110 may include recess 112 and may be further structured for accepting and generally supporting a base member positioned therein. Further, support portion 116 may be configured for accommodating a structural element for applying a force to a base member positioned within recess 112, as discussed in greater detail below. Anchor portion 118 of bit blade 110 may be structured for providing a structure for coupling a structural element thereto to apply a force to a base member positioned within recess 112.

Figure 21:
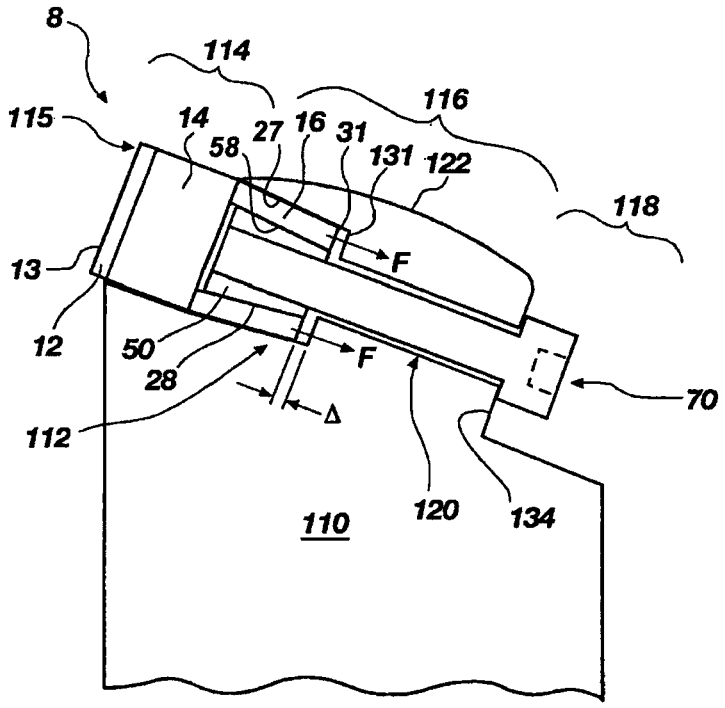
FIG. 21 shows a schematic side cross-sectional view of one embodiment of a bit blade as shown in FIG. 20 including one embodiment of a cutting element assembly.

FIG. 21 shows a side cross-sectional view of the bit blade 110 shown in FIG. 20, wherein a cutting element assembly 10, as shown in FIG. 16, is positioned therein. More specifically, cutting element 8 is positioned generally within cutting pocket portion 114 and base member 16 is positioned generally within recess 112 formed within support portion 116. As may also be seen in FIG. 21, the uppermost tip 115 of the cutting face 13 of the cutting element 8 may be positioned above the upper surface 122 of the bit blade 110, to provide clearance therebetween. Such clearance may be desirable so that the cutting element 8 contacts the subterranean formation to be drilled, thus cutting and removing material from the formation. Excessive contact between the bit blade 110 and a formation may inhibit cutting by the cutting element(s) on a rotary drill bit. Of course, the upper surface 122 of bit blade 110 may be structured for contacting a subterranean formation during drilling to limit a depth-of-cut (i.e., a rate-of-penetration) of a cutting element associated therewith, as known in the art. Further, cutting face 13 of cutting element 8 may be disposed at a back rake angle and a side rake angle as known in the art. Explaining further, as known in the art, cutting elements, such as PDC cutters, may be typically oriented so that a cutting-face thereof exhibits a negative back rake angle, or, in other words, so that the cutting-face forms an acute angle with the surface of the formation during drilling. Also, typically, a cutting element may be oriented at a negative side rake angle. Such negative back rake, side rake, or both may reduce or inhibit premature failure or damage to PDC cutters. Further, a cutting element 8 may be located at a given radius on a bit crown and will traverse through a helical path upon each revolution of the drill bit during drilling. The geometry (pitch) of the helical path is determined by the rate of penetration of the bit (ROP) and the rotational speed of the drill bit. The pitch affects the so called "effective back rake" of the cutting element, because it affects the geometry of the surface of the formation and the trajectory of the cutting element 8, as known in the art. Further, a PDC cutter may include a chamfer or buttress or may embody any other cutting edge geometry as known in the art, without limitation.

As shown in FIG. 21, recess 112 of a bit blade 110 may be structured for accepting a base member 16 having a tapered exterior so that a cross-sectional size of the base member 16 decreases with respect to an increasing distance from back surface 26 of cutting element 8. Put another way, at least a portion of recess 112 may be tapered to substantially correspond to (i.e., being congruent with) at least a portion of the tapered exterior surface 27 of base member 16. Such a configuration reduces tensile stress in the base member 16 when it is biased into the recess 112. Put another way, such a configuration may promote compressive stress within base member 16, which may be beneficial for avoiding failure of the base member 16 under loading associated with drilling a subterranean formation with the cutting element 8. Thus, in one embodiment, each of base member 16 and recess 112 may be substantially frustoconical. Further, optionally, a gap A may exist between a back surface 31 of base member 16 and back surface 131 of recess 112.

In addition, structural element 70 may extend between inner member 50 and a back surface 134 of bit blade 110. Structural element 70 may comprise a fastener as known in the art. More particularly, in one embodiment, as shown in FIG. 21, structural element 70 may comprise a bolt or machine screw (e.g., a so-called socket-head cap screw). In other embodiments, structural element 70 may comprise any threaded fastener as known in the art, without limitation. Structural element 70 may be effectively fixed to or against one end of through hole 120 (i.e., against back surface 134 of bit blade 110), so that a force, labeled F, may be generated on base member 16. Force F is shown schematically in two places in FIG. 21, but may actually be generated as a single force along contacting portions of interior surface 28 of base member 16 and exterior surface 58 of inner member 50.

Such a force F may bias the tapered base member 16 into the recess 112, which may effectively lock or couple the base member 16 therein. In such a configuration, force F may be developed by rotating the structural element 70 (in contact with back surface 134 of bit blade 110), causing structural element 70 to be removed in a direction generally away from cutting element 8. In turn, inner member 50 may generate a force F on the base member 16. As shown in FIG. 21, force F may be substantially perpendicular to the cutting face 13 of the cutting element 8 and may be oriented in a direction generally away from the cutting face 13 of the cutting element 8. Such a force F may be sufficient for retaining cutting element 8 within bit blade 110 during drilling of a subterranean formation therewith. Further, force F may have a selected magnitude. For example, a force F may have a magnitude less than about 10,000 lbs. In one embodiment, force F may be between about 3,000 lbs. and about 4,000 lbs. In one process, a selected torque may be applied to a threaded element (e.g., a structural element, anchor element, or other threaded member) for generating a selected force F upon base member 16. In another process, a force may be applied to cutting element 8 and the structural element 70 may be affixed to the bit blade 110. Upon releasing the force to the cutting element 8, a force F may be generated upon base member 16 by the structural element 70 affixed to the bit blade 110. Such a configuration may be advantageous, because a cutting element 8 may be coupled to and removed from a bit blade 110 without heating processes associated with brazing the cutting element 8 to the bit blade 110.

Of course, other processes may be employed for producing a force F on base member 16. For instance, a force may be applied to structural element 70 by mechanical devices (e.g., a cam mechanism, a hydraulic piston, or any other device for developing a force upon structural element 70 as known in the art) and the structural element 70 may be affixed to or otherwise mechanically locked or coupled to the bit blade 110 to generate a selected magnitude of force upon base element 16. For example, structural element 70 may be brazed, deformed, pinned, or otherwise affixed or mechanically locked to the bit blade 110 to generate a selected magnitude of force upon base element 16. Even if brazing is employed for affixing structural element 70 to a bit blade 110, such brazing may be beneficial in comparison to conventional brazing of a substrate of a cutting element to the bit blade, because the heating may be at least partially localized to the structural element 70 (i.e., not directly applied to cutting element 8). In another alternative, it should be understood that a force of a desired magnitude may be applied to the cutting face 13 of the cutting element 8 to force the base member 16 into the recess 112 while affixing or otherwise mechanically locking the structural element 70 to the bit blade 110. It should be understood that FIGS. 20 and 21 illustrate a cutting element 8 that may comprise a generally cylindrical cutting element. Further, while FIG. 20 shows an exemplary schematic cross-sectional view of bit blade 110, the bit blade 110 shape may be tapered, rounded, or acutely shaped in extending from a bit body as may be desired or as known in the art.

Figure 21B:
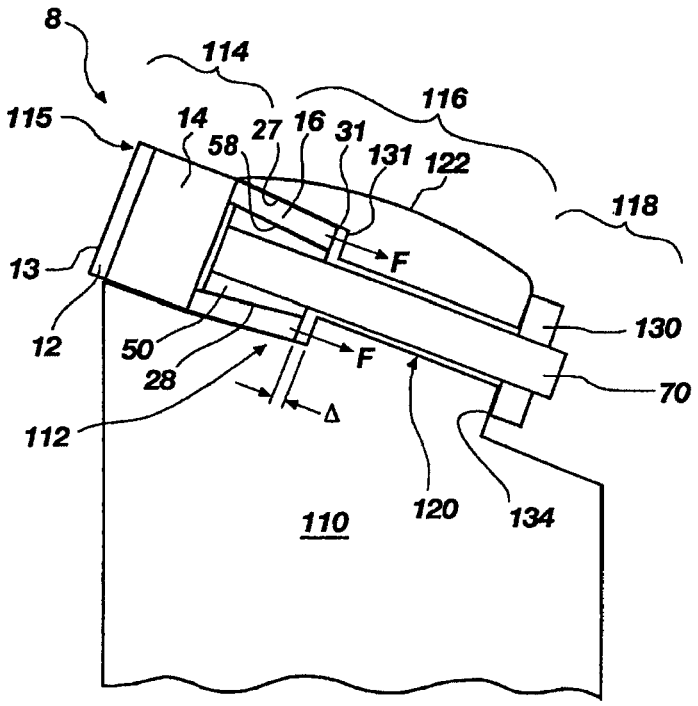
FIG. 21B shows a schematic side cross-sectional view of a further embodiment of a bit blade as shown in FIG. 20 including one embodiment of a cutting element assembly.

In another embodiment, as shown in FIG. 21B, structural element 70 may have a threaded end (e.g., threaded end region 76 as shown in FIG. 16) that engages anchor element 130, which may comprise a threaded nut. Of course, lock washers or other elements that are used in combination with fasteners (as known in the art) may be employed in combination with structural element 70. Such a configuration may provide relative flexibility and ease of use of a cutting element retention structure according to the present invention.

Figure 21C:
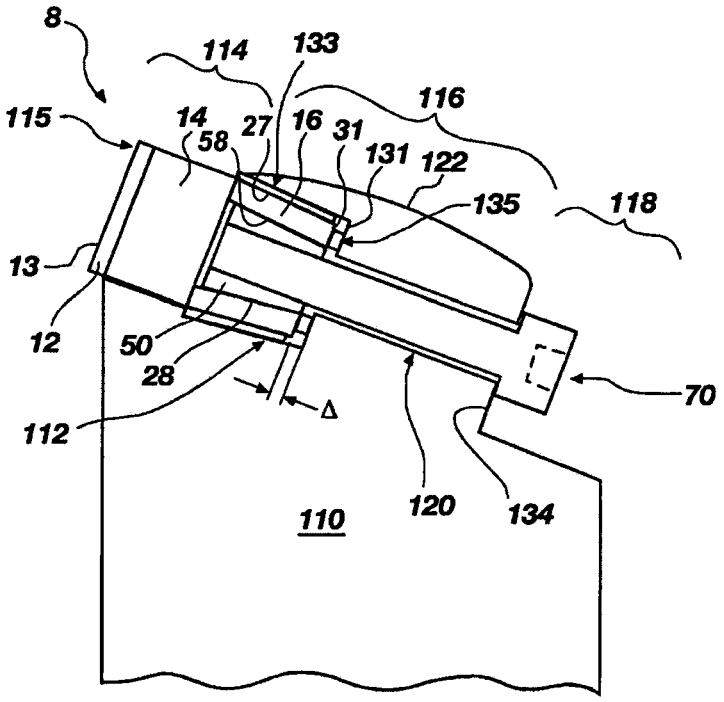
FIG. 21C shows a schematic side cross-sectional view of another embodiment of a bit blade as shown in FIG. 20 including a deformable element and a deformable layer positioned between the base element and the recess.

Additionally and optionally, as shown in FIG. 21C, a washer element may be positioned between the back surface 131 of recess 112 and a back surface 31 of base member 16. For example, a deformable element 135 (e.g., a deformable washer) may be positioned between the back surface 131 of recess 112 and a back surface 31 of base member 16. Similarly, optionally, as shown in FIG. 21C, a deformable layer 133 or material may be positioned between the exterior surface 27 of the base member 16 and the recess 112 of the bit blade 110. For example, a layer (e.g., a shim) of material may be positioned between the base member 16 and the recess 112 and then the base member 16 may be positioned in a desired position within recess 112. In one embodiment, the layer of material may comprise a solid metal shim or other material shim as known in the art. In a further embodiment, the layer of material may comprise a porous metal, a metal mesh or wire mesh, a powdered metal, a metal having a desired level of porosity, or another material having a suitable level of deformability or compliance. In another embodiment, a coating (e.g., a metal, such as for instance, copper, nickel, etc.) may be formed (e.g., electroplated, thermally sprayed, sputtered, electrolessly deposited, or otherwise formed or deposited as known in the art) upon at least a portion of the exterior surface 27 of the base member or upon a surface of the recess 112, or both. Such a configuration may facilitate relatively uniform contact between the recess 112 and the base member 16. Also, such a deformable material, a deformable washer, or both may provide compliance or tolerance for inaccuracies in manufacturing either of the recess 112 or the base member, or both, or may provide a mechanism for allowing relatively uniform contact between the recess 112 and the base member 16 despite wear or relatively slight changes to the shape or size of recess 112 (e.g., during use of a rotary drill bit).

Figure 22:
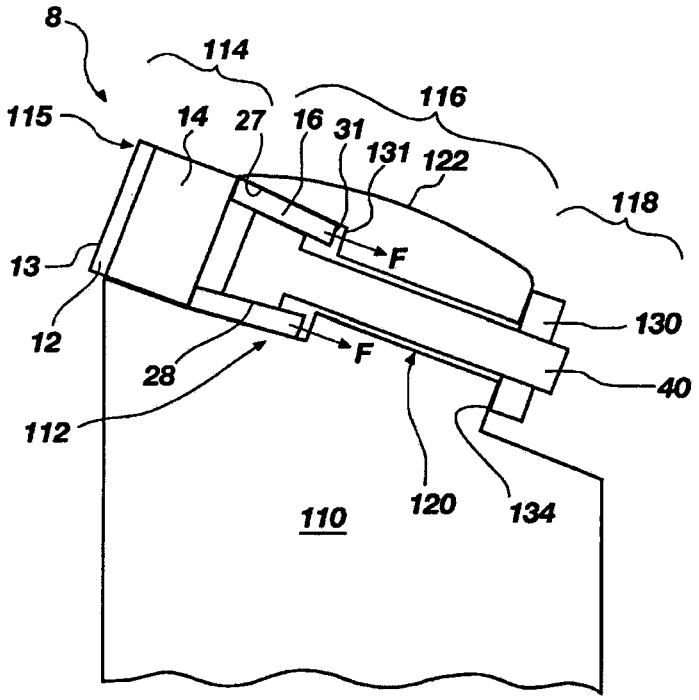
FIG. 22 shows a schematic side cross-sectional view of the embodiment of a bit blade as shown in FIG. 20 including an embodiment of a cutting element assembly.

The present invention contemplates that any of the above-described embodiments of a base member affixed to a cutting element may be utilized for affixing such a cutting element to a rotary drill bit. For example, FIG. 22 shows bit blade 110 according to the present invention including a cutter assembly 10 generally as described and shown in FIG. 5. Thus, recess 112 of a bit blade 110 may be structured for accepting a base member 16 having a tapered exterior so that a cross-sectional size of the base member 16 decreases with respect to an increasing distance from back surface 26 of cutting element 8. Put another way, at least a portion of recess 112 may be tapered and may substantially correspond to at least a portion of the tapered exterior surface 27 of base member 16. Further, structural element 40 may extend between base member 16 and anchor element 130 and may be effectively anchored at one end of through hole 120 by anchor element 130, so that a force, labeled F, may be generated on base member 16 in a direction that is generally away from cutting face 13 of cutting element 8. In one embodiment, structural element 40 may have a threaded end (e.g., threaded end region 76 as shown in FIG. 16) that engages anchor element 130, which may include a threaded recess (e.g., a threaded recess of a nut) for coupling to the structural element 40. In addition, a pin (e.g., cotter pin, a locking element as shown in FIG. 17), adhesives (e.g., LOCTITE®), or deformation (e.g., via peening), may be employed for preventing relative rotation of anchor element 130 with respect to structural element 40.

Figure 23:
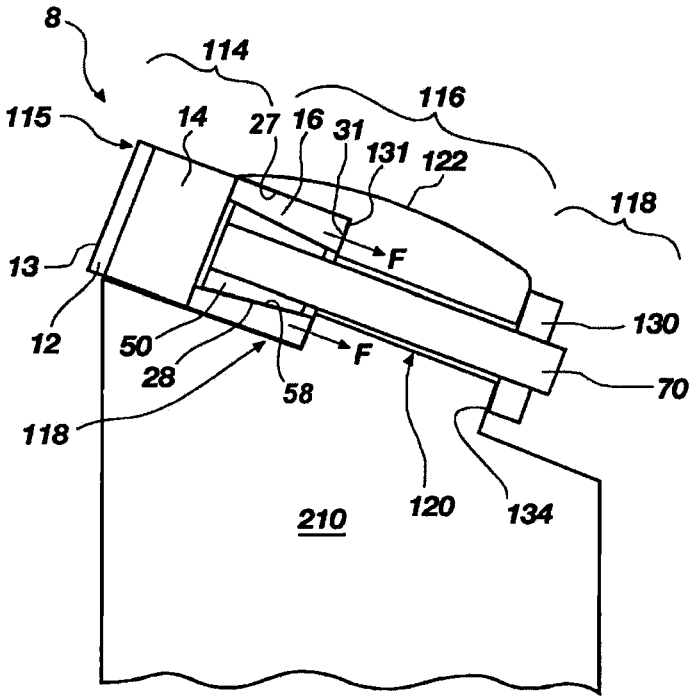
FIG. 23 shows a schematic side cross-sectional view of another embodiment of a bit blade as shown in FIG. 20 including yet a further embodiment of a cutting element assembly.

In a further embodiment of the present invention, a bit blade may include a recess that is structured for press-fitting of a base member therein. For example, FIG. 23 shows bit blade 210 according to the present invention including a cutter assembly 10 generally as described and shown in FIG. 5. Thus, recess 118 of a bit blade 210 may be structured for accepting a base member 16 having an exterior surface 27 that is substantially parallel to a central axis 11 of the cutting element 8. Optionally, recess 118 may be sized to exhibit interference with exterior surface 27 of base member 16. Such a configuration may provide a "press-fit" between the base member 16, which may effectively secure the base member 16 and cutting element 8 to bit blade 210. In addition, a back surface 31 of base element 16 may contact a back surface 131 for support of the base member 16 against the forces or moments created during drilling a subterranean formation with cutting element 8. Further, structural element 70 may extend between inner member 50 and anchor element 130 to secure base member 16 within bit blade 210. Optionally, a force, labeled F, may be generated on base member 16, if the press-fit between base element 16 and recess 118 is not sufficient for providing effective securement therebetween. Structural element 70 and anchor element 130 may be configured as described hereinabove.

Figure 24:
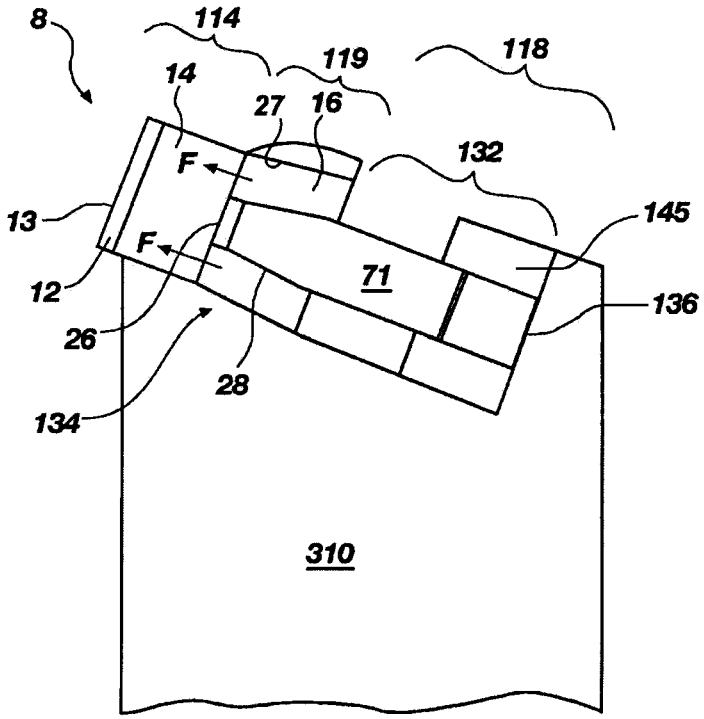
FIG. 24 shows a schematic side cross-sectional view of yet an additional embodiment of a bit blade according to the present invention including yet an additional embodiment of a cutting element assembly.

In a further embodiment of a base member affixed to a cutting element which may be utilized for affixing such a cutting element to a rotary drill bit, FIG. 24 shows bit blade 310 according to the present invention including a cutting pocket portion 114, a support portion 119, and a recessed portion 132. As shown in FIG. 24, recess 134 of bit blade 310 may be structured for accepting a base member 16 having a tapered exterior so that a cross-sectional size of the base member 16 increases with respect to an increasing distance from back surface 26 of cutting element 8. Put another way, if base member 16 is substantially frustoconical, recess 134 may be substantially frustoconical and may be sized to substantially correspond to at least a portion of the exterior surface 27 of base member 16. Further, structural element 71 may extend between base member 16 and anchor element 145. Optionally, a force, labeled F, directed generally toward the cutting face 13 of cutting element 8 and generally perpendicular thereto may be generated on base member 16 by contact between structural element 71 and base member 16. Such a force F may bias the base member 16 into recess 134. Explaining further, structural element 71 may be sized to fit within recessed portion 132 of bit blade 110 and anchor element 145 may be threaded onto structural element 71. Thus, relative rotation of structural element 71 and anchor element 145 may force an end of structural element 71 into base member 16 and anchor element 145 against surface 136 of recessed portion 132 to generate force F. Structural element 71 may be mechanically coupled to anchor element 145 or directly to bit blade 310 as described above or as otherwise known in the art. It should be understood that recess 134 may be, in another embodiment, substantially cylindrical and sized so that a substantially cylindrical base member may be press-fit therein.

Figure 25:
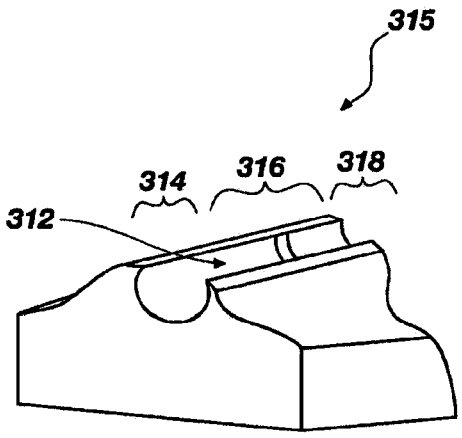
FIG. 25 shows a partial perspective view of a bit blade including a recess for accepting a cutting element assembly according to the present invention.

Although the embodiments of bit blade 110, 210, and 310 each include a support portion 116 or 119, respectively, which completely surrounds at least a portion of a periphery of the base member 16, the present invention is not so limited. Rather, it should be understood that support portion 116 or 119, particularly, recess 112 or recess 134 may not completely surround a periphery of a base member positioned therein. Thus, a recess 112 or recess 134 may surround a portion of a periphery of a base member positioned therein to mechanically couple or secure a base member to a bit blade. For example, FIG. 25 shows a partial perspective view of one embodiment of a bit blade 315 having a recess 312 formed therein sized and configured to accept a base element affixed to a cutting element (e.g., a PDC cutter). In addition, FIG. 25 shows a cutting pocket portion 314 of bit blade 315, a support portion 316 of bit blade 315, and an anchor portion 318 of bit blade 315. Cutting pocket portion 314 of bit blade 315 may be generally configured for surrounding a portion of a circumference of a substantially cylindrical cutting element positioned therein and may inhibit erosion of a substrate of such a cutting element (e.g., a PDC cutter). Support portion 316 of bit blade 315 may include a recess 312 configured for surrounding a portion of a periphery (e.g., a circumference) of a base member (e.g., a substantially cylindrical base member) positioned therein. Further, support portion 316 may be configured for accommodating a structural element for applying a force F to a base member positioned within recess 312, as discussed above. Anchor portion 318 of bit blade 315 may be structured for providing a structure for coupling a structural element thereto to apply a force to a base member positioned within recess 312.

Figure 26:
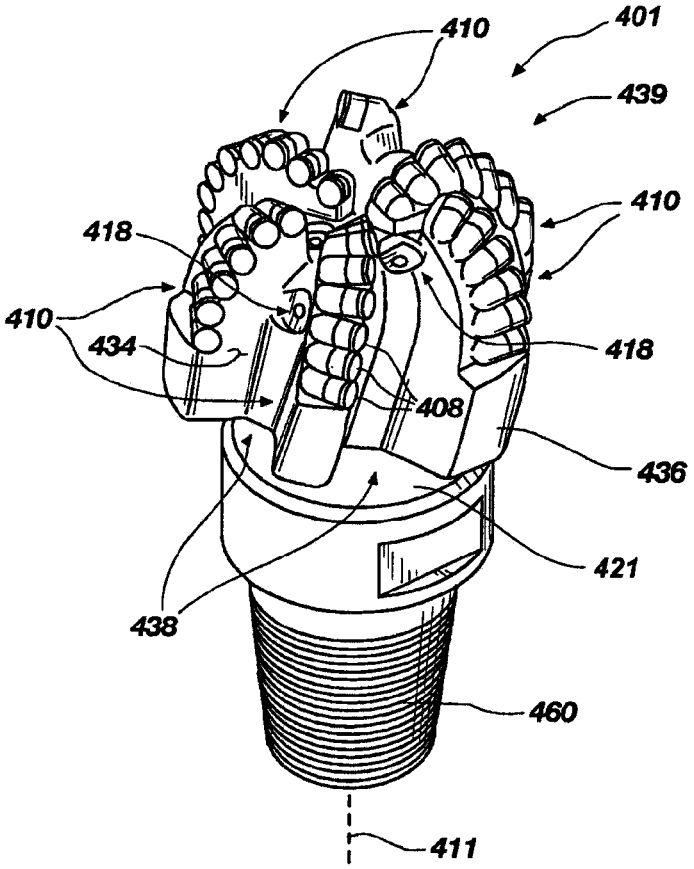
FIGS. 26 and 27 each show a perspective view and a top elevation view of a rotary drill bit including at least one cutting element assembly according to the present invention.
Figure 27:
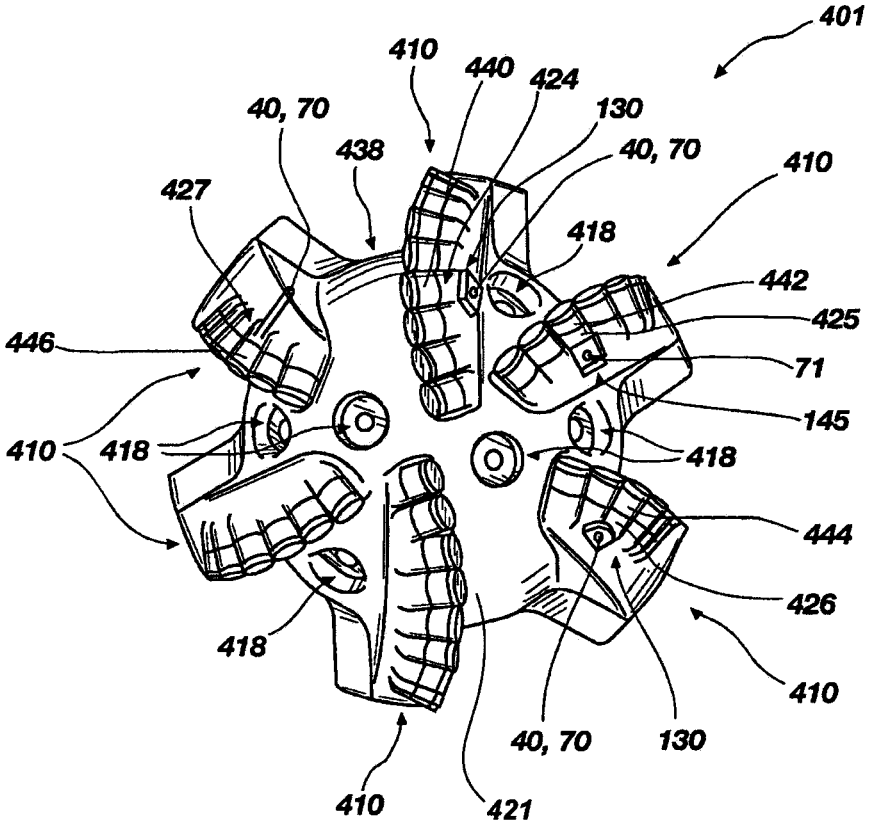

As may be appreciated from the foregoing discussion, the present invention further contemplates that a cutting element and base member affixed thereto may be coupled to a rotary drill bit. For example, FIG. 26 shows a perspective view of an exemplary rotary drill bit 401. FIG. 27 is a top view of the rotary drill bit 401 illustrated in FIG. 26, wherein a plurality of cutting elements 440, 442, 444, and 446 are secured to bit body 421 of rotary drill bit 401 by base members 424, 425, 426, and 427, respectively, according to the present invention. Generally, rotary drill bit 401 includes a bit body 421 which defines a leading end structure for drilling into a subterranean formation. More particularly, rotary drill bit 401 may include radially and longitudinally extending blades 410 including leading faces 434. Further, circumferentially adjacent blades 410 define so-called junk slots 438 therebetween, as known in the art. As shown in FIG. 26, rotary drill bit 401 may also include, optionally, cutting elements 408 (e.g., generally cylindrical cutting elements such as PDC cutters) which are conventionally affixed to radially and longitudinally extending blades 410 (i.e., bit body 421). Additionally, rotary drill bit 401 includes nozzle cavities 418 for communicating drilling fluid from the interior of the rotary drill bit 401 to the cutting elements 408, face 434, and threaded pin connection 460 for connecting the rotary drill bit 401 to a drilling string, as known in the art.

Base members 424, 425, 426, and 427 may comprise any of the above-described embodiments of a base member (e.g., base member 16 as shown hereinabove) according to the present invention. It should be understood that although rotary drill bit 401 shows four base members 424, 425, 426, and 427, the present invention is not limited by such an example. Rather, a rotary drill bit according to the present invention may include, without limitation, one or more cutting element assemblies according to the present invention. Further, however, more specifically, as shown schematically in FIG. 27, each of base members 424, 425, 426, and 427 may be positioned within a recess formed in blades 410, respectively. Turning back to the exemplary rotary drill bit 401 shown in FIGS. 26 and 27, respective structural elements 40, 71, or 70 may be employed in combination with any of base members 424, 425, 426, and 427 according to any of the embodiments discussed above. Further, optionally, anchor elements 130 or 145, may be appropriately employed for affixing a cutting element 408 to a bit blade 410. As discussed above, in one embodiment, any of base members 424, 425, 426, or 427 may be substantially cylindrical and may be positioned within a recess that surrounds more than half of a cross-sectional circumference of any of base members 424, 425, 426, or 427, respectively. Optionally, any of base members 424, 425, 426, or 427 may be press-fit within a recess formed within an associated bit blade 410. As shown in FIG. 27, a suitable structural element 40, 70, or 71 may be employed for securing a base member (e.g., a base member 424, 425, 426, or 427) to a bit blade 410. Any of cutting elements 440, 442, 444, or 446 may comprise a superabrasive layer affixed to a substrate, such as a PDC cutter.

It should be understood that FIGS. 26 and 27 merely depict one example of a rotary drill bit employing various embodiments of a cutting element assembly of the present invention, without limitation. More generally, a rotary drill bit may include at least one cutting element assembly (i.e., at least one cutting element affixed to a base member) according to the present invention, without limitation. Thus, as illustrated and described above, one or more cutting element assembly embodiment of the present invention may be employed for coupling one or more respective cutting elements to a rotary drill bit.

Figure 28:
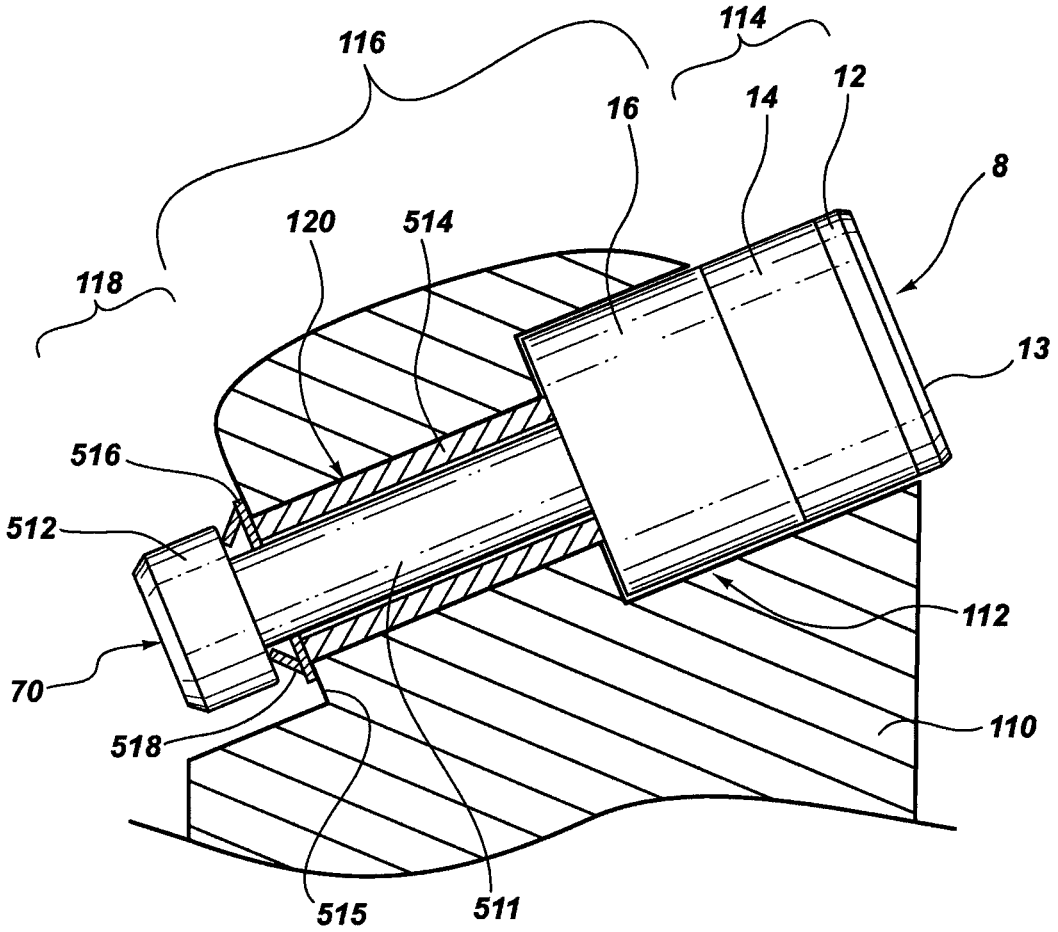
FIG. 28 shows a cross-sectional side view of a bit blade according to at least one embodiment.

FIG. 28 is a cross-sectional side view of bit blade 110 according to at least one embodiment. As with previous embodiments, cutting element 8 may be positioned generally within cutting pocket portion 114 of bit blade 110, and base member 16 may be positioned generally within recess 112 formed within support portion 116 of bit blade 110. Additionally, structural element 70 may be positioned within support portion 116 and anchor portion 118 of bit blade 110.

As with previous embodiments, cutting element 8 may include a layer or table 12 affixed to or formed upon a substrate 14. Table 12 may be formed of any material or combination of materials suitable for cutting formations, including, for example, a superhard or superabrasive material such as polycrystalline diamond. Similarly, substrate 14 may comprise any material or combination of materials capable of adequately supporting a superabrasive material during drilling of a subterranean formation, including, for example, cemented tungsten carbide. For example, cutting element 8 may comprise a table 12 comprising polycrystalline diamond bonded to a substrate 14 comprising cobalt-cemented tungsten carbide. In at least one embodiment, after formation of table 12, a catalyst material (e.g., cobalt or nickel) may be at least partially removed (e.g., by acid-leaching) from table 12. Base member 16 may also be affixed to substrate 14 through any suitable method, such as, for example, brazing.

In at least one embodiment, structural element 70 may be employed in combination with cutting element retention structures or assemblies for securing or supporting a cutting element within a rotary drill bit body. For example, structural element 70 may include an end portion that is sized and configured to fit within a recess of base member 16 (see, e.g., FIG. 4). Structural element 70 may also comprise a fastener as known in the art. For example, structural element 70 may comprise a bolt or machine screw (e.g., a socket-head cap screw). Structural element 70 may also comprise any threaded fastener as known in the art, without limitation. Additionally, structural element 70 may comprise a threaded end portion configured to fit within a corresponding threaded aperture in base member 16.

In various embodiments, structural element 70 may comprise a shaft portion 511, which may be positioned within a through hole 120 in support portion 116. Structural element 70 may also comprise an anchor element 512 located at an end portion of structural element 70 opposite cutting element 8. Anchor element 512 may be positioned in or adjacent to anchor portion 118 of bit blade 110. Anchor element 512 may also be adjacent to an anchor surface 515 of bit blade 110. In at least one embodiment, anchor element 512 may be integrally formed with shaft portion 511 of structural element 70. Alternatively, anchor element 512 may be fastened to shaft portion 511. For example, structural element 70 may have a threaded end that engages a threaded aperture in anchor element 512, which may comprise a threaded nut. Lock washers or other elements that are used in combination with fasteners (as known in the art) may also be employed in combination with structural element 70.

In certain embodiments, as shown in FIG. 28, a metal sleeve 514 may be positioned within through hole 120 defined in bit blade 110. Metal sleeve 514 may be sized to contact at least a surface portion of bit blade 110 defining through hole 120. Metal sleeve 514 may also be sized to surround at least a portion of shaft portion 511 of structural element 70. Metal sleeve 514 may be formed of any suitable material. For example, metal sleeve 514 may comprise a metal material that allows rotation of shaft portion 511. Optionally, metal sleeve 514 may have a hardness that is less than a hardness of shaft portion 511. Accordingly, if shaft portion 511 rotates, particles such as relatively hard and/or abrasive particles may become embedded into metal sleeve 514. By allowing particles to become embedded in metal sleeve 514, metal sleeve 514 may prevent such particles, from interfering with or disabling the rotation of shaft portion 511, and likewise, the rotation of base member 16 and cutting element 8 in bit blade 110. Additionally, metal sleeve 514 may inhibit damage to any portion of structural element 70, base member 16, cutting element 8, or any portion of bit blade 110 from abrasive particles.

Figure 29:
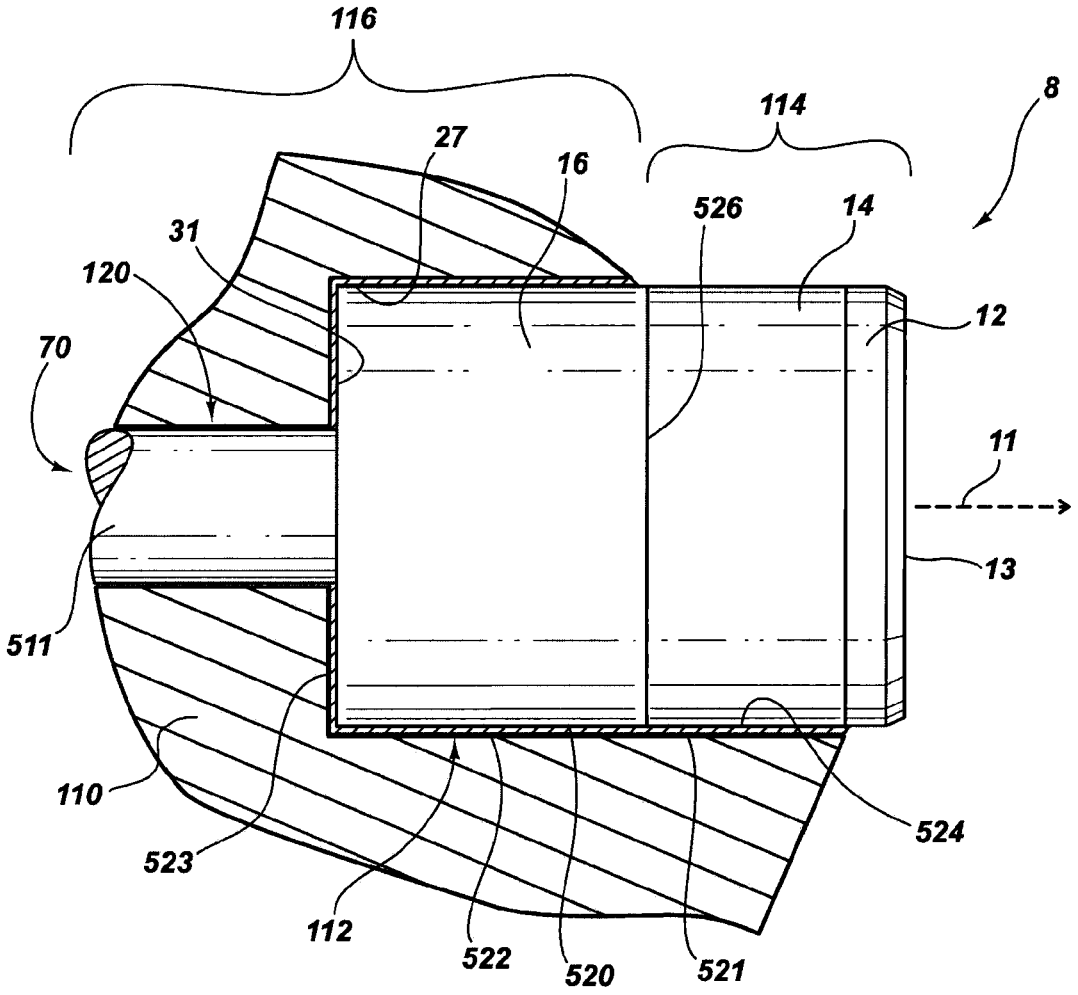
FIG. 29 shows a cross-sectional side view of a portion of an exemplary bit blade according to an additional embodiment.

FIG. 29 is a cross-sectional side view of a portion of bit blade 110, in which cutting element 8, base member 16, and a portion of structural element 70 are disposed, according to at least one embodiment. Base member 16 may be affixed to substrate 14 through any suitable method, such as, for example, brazing. As shown in FIG. 29, a braze joint 526 may be located between substrate 14 and base member 16. Cutting table 12 may comprise a cutting face 13, which may be generally perpendicular to a central axis 11 of cutting element 8. Central axis 11 may be substantially centered (i.e., positioned at a centroid) with respect to a selected cross-sectional area (e.g., a solid cross-sectional area or a cross-sectional area bounded by an exterior surface, without limitation) of cutting element 8. As shown in FIG. 29, substrate 14 may have an exterior surface 524 that may be substantially parallel or nonparallel with respect to central axis 11 of cutting element 8. Base member 16 may also have an exterior surface 27 that may be substantially parallel or nonparallel with respect to central axis 11 of the cutting element. In addition, base member 16 may have a back surface 31.

As with previous embodiments, bit blade 110 may have a cutting pocket portion 114 configured to surround at least a portion of cutting element 8. Additionally, bit blade 110 may include a support portion 116 comprising a recess 112 formed therein that may be sized and configured to accept base member 16 affixed to cutting element 8. In an additional embodiment, at least a portion of cutting pocket portion 114 and/or at least a portion of recess 112 may include a coating 520. Coating 520 may comprise any number or combination of materials. In various embodiments, coating 520 may comprise a hard, protective coating material. Coating 520 may be formed on a cutting pocket surface 521 of cutting pocket portion 114, which may surround and face an exterior surface 524 of substrate 14. In certain embodiments, coating 520 may also be formed on at least a portion of cutting pocket surface 521. For example, such coating 520 may be formed upon at least a portion of cutting table 12. Optionally, coating 520 may be formed on at least a portion of recess surface 522 of recess 112, which may optionally surround and face an exterior surface 27 of base member 16. Coating 520 may optionally be formed on at least a portion of back recess surface 523 of recess 112.

Coating 520 may act as a bushing or surface bearing for cutting element 8 and/or base member 16. Coating 520 may protect at least a portion of cutting pocket portion 114 and/or at least a portion of recess 112 from wear or damage resulting from movement of cutting element 8 and/or base member 16 relative to cutting pocket 114 and/or recess 112. In another embodiment, coating 520 may protect cutting element 8 and/or base member 16 from wear and/or damage. In a further embodiment, coating 520 may also reduce frictional forces generated between cutting element 8 and cutting pocket portion 114 during movement of cutting element 8 relative to cutting pocket portion 114. Likewise, coating 520 may reduce frictional forces generated between base member 16 and recess 112 during movement of base member 16 relative to recess 112. Such a configuration may reduce the temperatures to which cutting pocket portion 114, recess 112, cutting element 8, base member 16, and any other portions of bit blade 110 are subjected.

Figure 30:
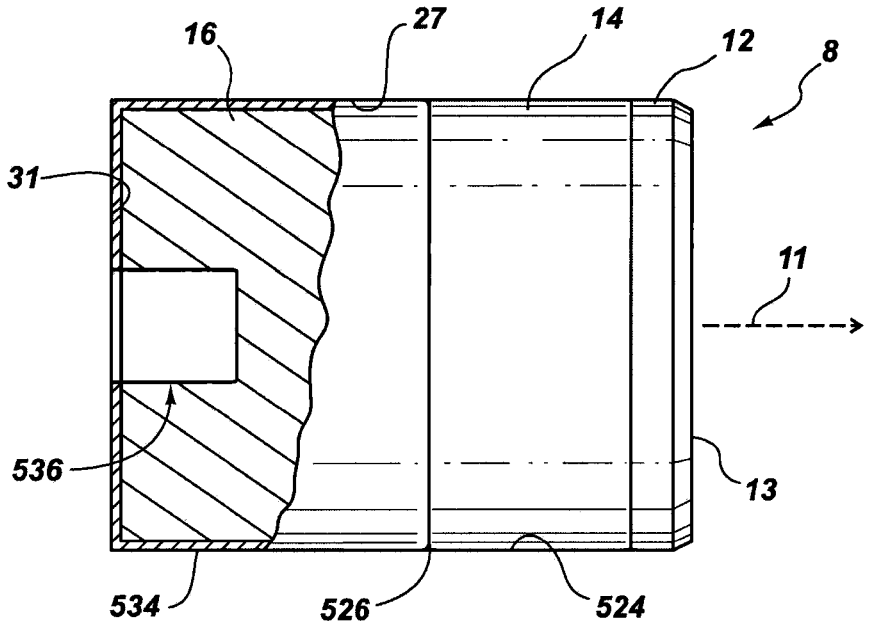
FIG. 30 shows a partial cross-sectional view of a cutting element according to certain embodiments.

FIG. 30 is a partial cross-sectional view of cutting element 8 according to an additional embodiment. As illustrated in this figure, cutting element 8 may comprise a cutting table 12 having a cutting face 13, which may be generally perpendicular to a central axis 11. Cutting element 8 may also comprise a substrate 14 having an exterior surface 524. Additionally, a base member 16 having an exterior surface 27 and a back surface 31 may be affixed to substrate 14. A braze joint 526 may be located between substrate 14 and base member 16, affixing substrate 14 to base member 16. Base member 16 may comprise any suitable material. For example, base member 16 may comprise a metal such as steel. Additionally, a coupling recess 536 may be defined in base member 16. Coupling recess 536 may be configured to receive a corresponding portion of a structural element, such as structural element 70, to couple the structural element to base member 16. In certain embodiments, an end portion of structural element 70 and coupling recess 536 may each be correspondingly threaded to facilitate affixing structural element 70 to base member 16.

In various embodiments, base member 16 may comprise a coating 534. Coating 534 may form at least a portion of exterior surface 27 and/or back surface 31. Coating 534 may represent any suitable coating, such as, for example, a tungsten/tungsten carbide coating. Coating 534 may optionally comprise an erosion resistant coating. In at least one embodiment, coating 534 may comprise a HARDIDE® (Hardide Coatings Inc., Houston, Tex.) coating. Coating 534 may also cover at least a portion of coupling recess 536 defined in base member 16. Optionally, coating 534 may be formed prior to forming coupling recess 536 in base member 16. Coupling recess 536 may be formed in base member 16 and coating 534 through any suitable means, such as, for example, machining. In certain embodiments, coating 534 may be formed on base member 16 prior to affixing (e.g., brazing) base member 16 to substrate 14. Accordingly, a portion of coating 534 may be positioned between base member 16 and substrate 14. In an additional embodiment, coating 534 may be selectively formed (e.g., on portions of base member 16 that will not be positioned between substrate 14 and base member 16 when substrate 14 and base member 16 are affixed to each other). Coating 534 may be formed on base member 16 after affixing base member 16 to substrate 14.

Coating 534 may resist chemical corrosion, thereby protecting base member 534 from corrosion. Additionally, coating 534 may increase the hardness or physical durability of exterior surface 27 and a back surface 31 of base member 16, thereby protecting base member 16 from wear or damage (e.g., damage resulting from movement of base member 16 in recess 112). Such a configuration may reduce frictional forces generated between base member 16 and recess 112 during movement of base member 16 relative to recess 112. By reducing the frictional forces, coating 534 may reduce the temperatures to which recess 112, base member 16, and any other portions of bit blade 110 are subjected.

Figure 31:
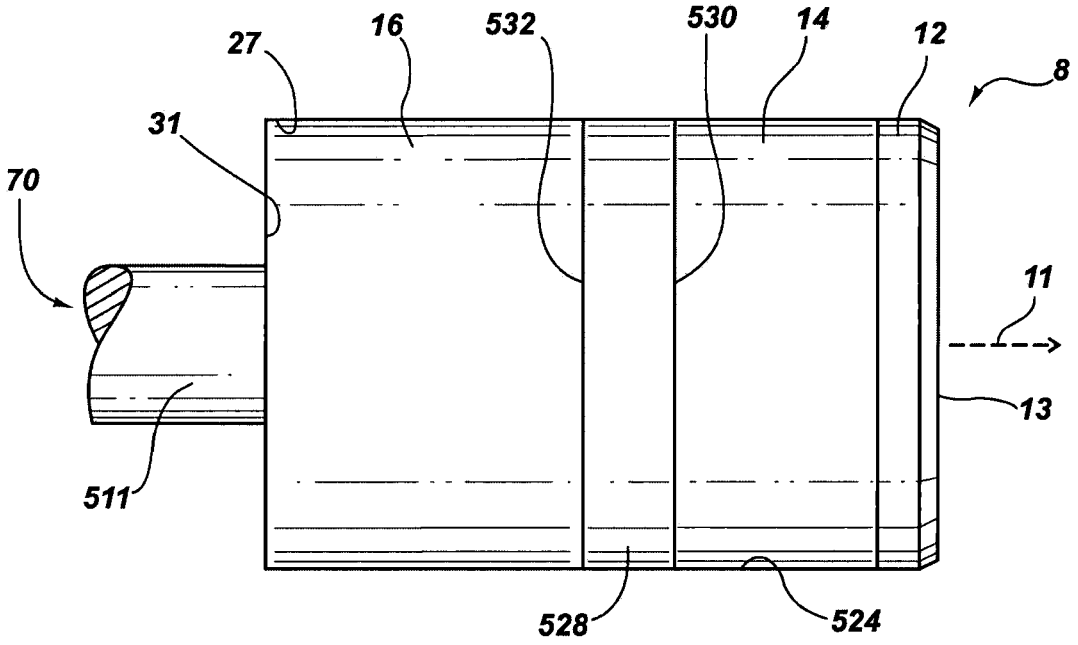
FIG. 31 shows a side view of an exemplary cutting element coupled to a structural element according to various embodiments.

FIG. 31 is a side view of cutting element 8 coupled to structural element 70 according to various embodiments. Cutting element 8 may include a layer or table 12 affixed to or formed upon a substrate 14. Substrate 14 may comprise any material or combination of materials capable of adequately supporting a superabrasive material during drilling of a subterranean formation, including, for example, cemented tungsten carbide. For example, cutting element 8 may comprise a table 12 comprising polycrystalline diamond bonded to a substrate 14 comprising cobalt-cemented tungsten carbide.

A base member 16 may also be affixed to substrate 14 through any suitable method, such as, for example, brazing. In one embodiment, as shown in FIG. 31, an intermediate base member 528 may be disposed between base member 16 and substrate 14. Intermediate base member 528 may comprise any suitable material. In various embodiments, intermediate base member 528 may comprise a material having a thermal expansion coefficient in a range between a thermal expansion coefficient of base member 16 and a thermal expansion coefficient of substrate 14. For example, substrate 14 may comprise a tungsten carbide material (e.g., cobalt-cemented tungsten carbide), base member 16 may comprise a steel material, and intermediate base member 528 may comprise a tungsten carbide material having a higher cobalt content than substrate 14.

Substrate 14 may be bonded to intermediate base member 528 through any suitable means, including, for example, brazing to form a first braze joint 530. Additionally, intermediate base member 528 may be bonded to base member 16 through any suitable means, including, for example, brazing to form a second braze joint 532. By bonding substrate 14 and base member 16 to intermediate base member 528, the physical durability of the bond between cutting element 8 and base member 16 may be increased. When cutting element 8 is subjected to various forces, such as rotational forces generated during drilling operations, intermediate base member 528 may help prevent separation of cutting element 8 from base member 16.

The inclusion of intermediate base member 528 may strengthen cutting element 8 and/or a cutting element assembly comprising cutting element 8 (see, e.g., cutting element assembly 10 in FIG. 1) by reducing various residual stresses in cutting element 8 and/or the cutting element assembly. For example, the inclusion of intermediate base member 528 may reduce residual stresses near first braze joint 530 and/or second braze joint 532. In various embodiments, residual stresses near first braze joint 530 and/or second braze joint 532 may be less than residual stresses near a braze joint in a cutting element assembly having only a single braze joint (see, e.g., braze joint 526 in FIG. 30). A reduction in residual stresses at any given location in cutting element 8 and/or a cutting element assembly comprising cutting element 8 may result in a strengthened cutting element assembly.

Smaller residual stresses may be a result of relatively closer thermal coefficient matching between adjacent materials, such as, for example, between a material in base member 16 and a material in intermediate base member 528 and/or between a material in intermediate base member 528 and a material in substrate 14. Accordingly, the inclusion of intermediate base member 528 may be particularly advantageous in situations where cutting element 8 is subjected to high temperatures. The differences in heat induced expansion between intermediate base member 528 and substrate 14 and between intermediate base member 528 and base member 16 may be significantly less than the difference in heat induced expansion between substrate 14 and base member 16. Accordingly, substrate 14 may be less likely to separate from intermediate base member 528 than from base member 16. Likewise, base member 16 may be less likely to separate from intermediate base member 528 than from substrate 14.

Figure 32:
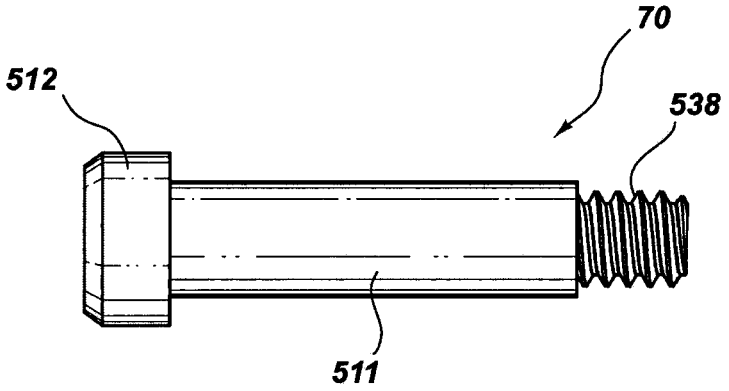
FIG. 32 shows a side view of a structural element according to at least one embodiment.
Figure 33:
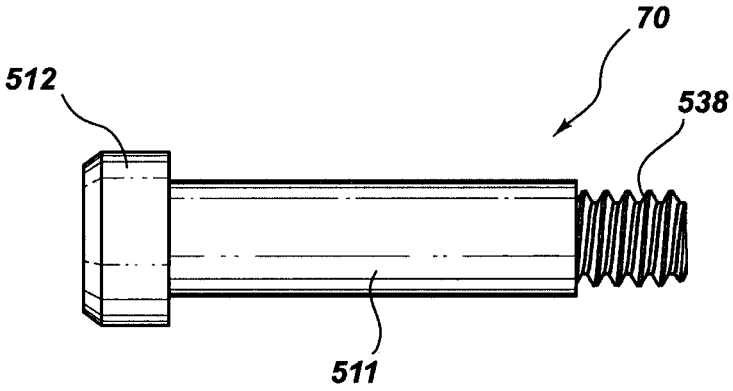
FIG. 33 shows a side view of a structural element according to an additional embodiment.

FIGS. 32 and 33 are side views of structural element 70 according to certain embodiments. As shown in these figures, structural element 70 may comprise a shaft portion 511 and an anchor element 512 located at an end portion of structural element 70. Structural element 70 may also comprise a coupling portion 538, located at an end opposite anchor element 512, that is sized and configured to fit within a recess of base member 16 (e.g., coupling recess 536). Coupling portion 538 may represent any type or form of structure capable of coupling structural element 70 to cutting element 8, either removably or permanently.

In at least one embodiment, coupling portion 538 may comprise a threaded end portion configured to fit within coupling recess 536 comprising a corresponding threaded recess. As shown in FIG. 32, coupling portion 538 may have a right-handed thread configuration. Coupling portion 538 having a right-handed thread configuration may be coupled to coupling recess 536 having a corresponding right-handed thread configuration. In an additional embodiment, as shown in FIG. 33, coupling portion 538 may have a left-handed thread configuration. In this embodiment, coupling portion 538 having a left-handed thread configuration may be coupled to coupling recess 536 having a corresponding left-handed thread configuration.

A coupling portion 538 having a particular thread configuration (e.g., a right-handed or a left-handed thread configuration) may enable cutting element 8 to be more closely and tightly coupled to structural element 70 in various situations. For example, as cutting element 8 contacts a rock formation and moves relative to the formation, it may tend to rotate in a particular direction (e.g., clockwise or counter-clockwise). The direction of rotation of cutting element 8 may vary depending on various cutting or other forces applied to cutting element 8 during operation of a drill bit (see, e.g., rotary drill bit 410 in FIG. 26). For example, in situations where the cumulative rotation of cutting element 8 tends to be in a clockwise direction respective to structural element 70, when viewed in a direction facing structural element 70 from cutting face 13, coupling portion 538 having a right-handed thread configuration, and corresponding coupling recess 536 having a right-handed thread configuration, may be utilized. Additionally, in situations where the cumulative rotation of cutting element 8 tends to be in a counter-clockwise direction respective to structural element 70, when viewed in a direction facing structural element 70 from cutting face 13, coupling portion 538 having a left-handed thread configuration, and corresponding coupling recess 536 having a left-handed thread configuration, may be utilized.

Figure 34:
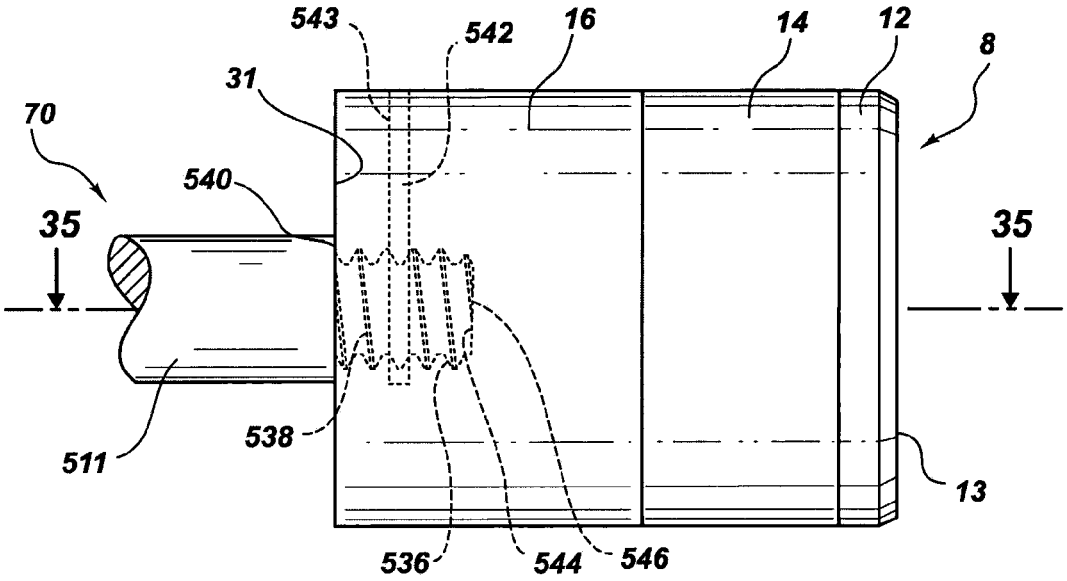
FIG. 34 shows a side view of a cutting element coupled to a structural element according to certain embodiments.
Figure 35:
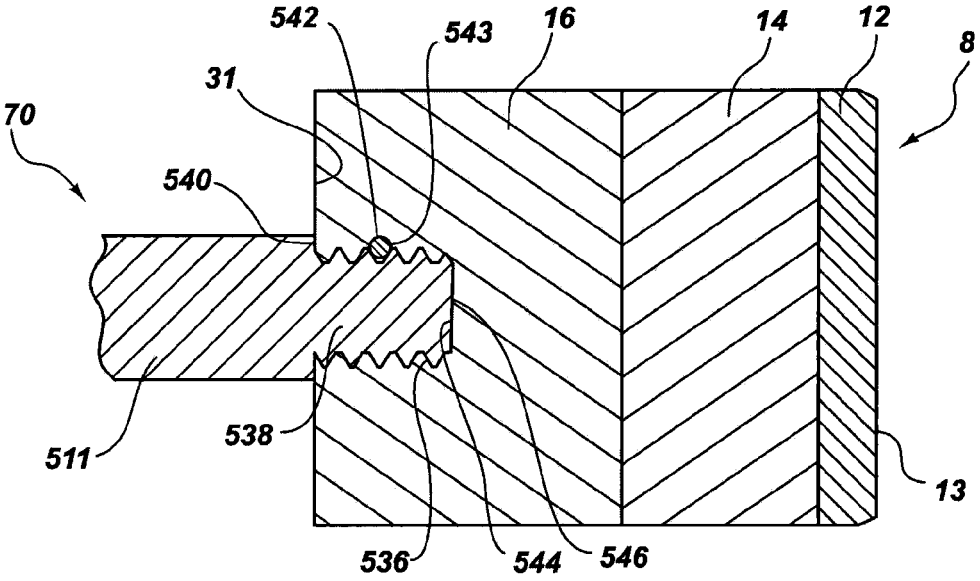
FIG. 35 shows a cross-sectional side view of the exemplary cutting element illustrated in FIG. 34.

FIG. 34 is a side view of cutting element 8 coupled to structural element 70 according to certain embodiments. FIG. 35 is a cross-sectional side view of cutting element 8 illustrated in FIG. 34 according to an additional embodiment. As with previous embodiments, cutting element 8 may include a layer or table 12 affixed to or formed upon a substrate 14. Table 12 may comprise a cutting face 13. A base member 16 may also be affixed to substrate 14. Additionally, a coupling recess 536 structured to receive at least a portion of a structural element 70 may be defined in base member 16. Structural element 70 may comprise a shaft portion 511 and a coupling portion 538. Coupling portion 538 may include a threaded end portion that is configured to fit within coupling recess 536 comprising a corresponding threaded recess.

In at least one embodiment, structural element 70 may comprise a shoulder portion 540 configured to contact a back surface 31 of base member 16. Shoulder 540 may have a larger outer diameter than each of coupling portion 538 and coupling recess 536. As shown in FIGS. 34 and 35, coupling portion 538 may comprise a front coupling face 544 at an end portion of structural element 70 facing base member 16. Additionally, base member 16 may comprise a back coupling surface 546 in coupling recess 536 facing structural element 70. In certain embodiments, front coupling face 544 of coupling portion 538 may contact back coupling surface 546 of base member 16 when structural element 70 is coupled to base member 16. In additional embodiments, a gap may exist between coupling face 544 of coupling portion 538 and back coupling surface 546 of base member 16 when structural element 70 is coupled to base member 16.

In various embodiments, when structural element 70 is coupled to base member 16, shoulder 540 may contact back surface 31 of base member 16. Additionally, a surface portion of shoulder 540 facing base member 16 abut against back surface 31. For example, structural element 70 may comprise a shoulder screw or shoulder bolt having a coupling portion 538 at one end with a threaded configuration that may be positioned generally within a corresponding coupling recess 536 defined in base member 16 until shoulder 540 bottoms out against back surface 31. When coupling portion 538 is positioned within coupling recess 536, shoulder 540 may be frictionally secured to back surface 31.

As shown in FIGS. 34 and 35, base member 16 may also comprise a locking pin 542 positioned in a locking pin hole 543 defined in base member 16. Locking pin 542 may represent any type or form of device for preventing rotation of base member 16 relative to structural element 70. Locking pin 542 may be fixably positioned in locking pin hole 543 through any suitable method. For example, locking pin 542 may be press fit into locking pin hole 543 or otherwise. As illustrated in FIGS. 34 and 35, locking pin 542 may contact at least a portion of coupling portion 538. In additional embodiments, locking pin 542 may extend into a corresponding recess or hole defined in base member 16.

Locking pin 542 may prevent coupling portion 538 from moving and/or dislodging from base member 16. For example, locking pin 542 may be used to secure and effectively lock in place coupling portion 538 having a threaded configuration. Coupling portion 538 having a threaded configuration may be positioned generally within coupling recess 536, and subsequently, locking pin 542 may be inserted into locking pin hole 543. Locking pin 542 may prevent rotation of coupling portion 538 with respect to coupling recess 536 to prevent coupling portion 538 from becoming unscrewed or otherwise removed from coupling recess 536. Such a configuration may provide a suitable structure for attaching structural element 70 to base member 16.

Figure 36:
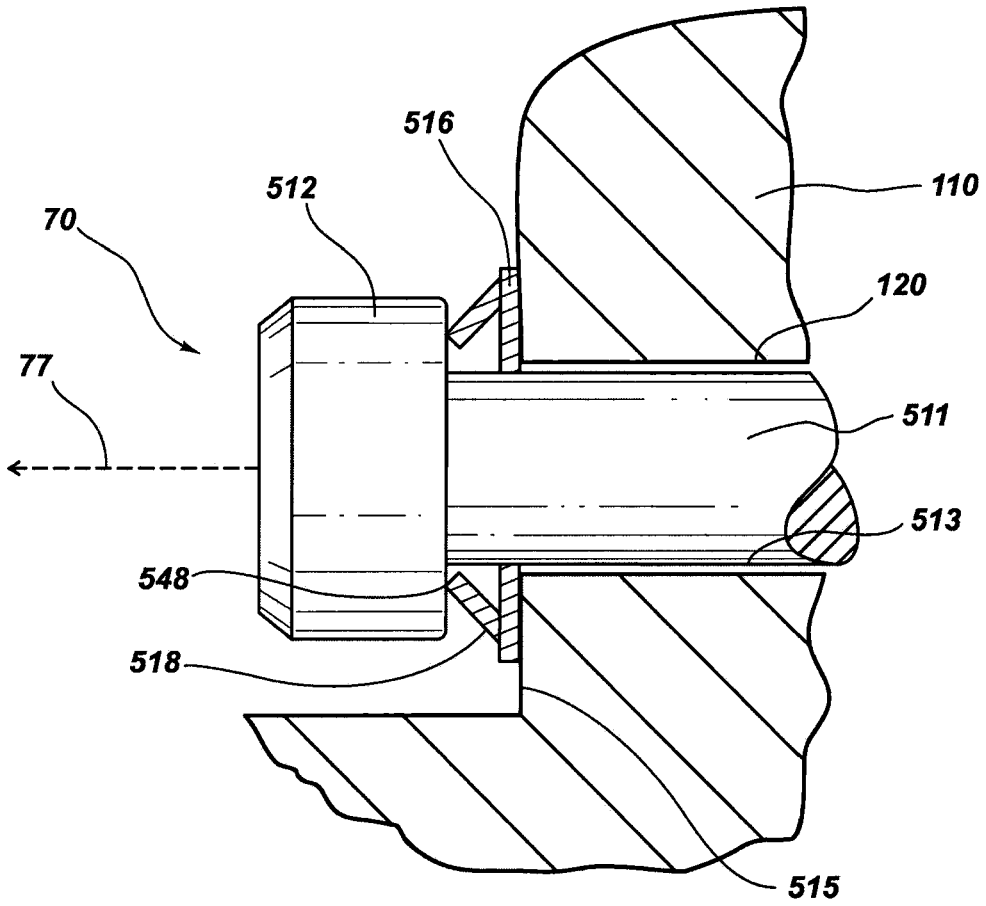
FIG. 36 shows a side view of a portion of a structural element positioned in a bit blade according to various embodiments.

FIG. 36 is a side view of a portion of structural element 70 positioned in bit blade 110 according to at least one embodiment. As with previous embodiments, structural element 70 may be positioned within support portion 116 and anchor portion 118 of bit blade 110 (see, e.g., FIG. 28). Structural element 70 may comprise shaft portion 511, which may be positioned within through hole 120 in support portion 116. Structural element 70 may also comprise anchor element 512 located at an end portion of structural element 70. Anchor element 512 may be adjacent to an anchor surface 515 of bit blade 110. In addition, anchor element 512 may comprise a front anchor surface 548 facing anchor surface 515. Structural element 70 may extend generally along a longitudinal axis 77. In an additional embodiment, structural element 70 may extend in a direction substantially parallel to a central axis of cutting element 8. Additionally, anchor surface 515 may be substantially perpendicular to longitudinal axis 77.

In at least one embodiment, a biasing element 518 (e.g., a Belleville washer spring or a coil spring) may be positioned between anchor element 512 and bit blade 110. Biasing element 518 may bias structural element 70 in a selected direction and/or may generate a selected force. For example, biasing element 518 may bias base member 16 and cutting element 8 respectively within support portion 116 and cutting pocket portion 114 of bit blade 110. Biasing element 518 may also enable a preload force to be applied to base member 16. Because biasing element 518 applies a preload force to base member 16, base member 16 and/or cutting element 8 may rotate in response to forces generated during drilling of a subterranean formation. Accordingly, biasing element 518 may position cutting element 8 in cutting pocket portion 114 of bit blade 110 while selectively allowing cutting element 8 to rotate in cutting pocket portion 114.

In various embodiments, a separation element 516 may be positioned between anchor element 512 and bit blade 110. Separation element 516 may comprise a washer or a layer of material, such as a metal or ceramic shim. Additionally, separation element 516 may be sacrificial (i.e., may be softer than anchor element 512 and/or bit blade 110). Separation element 516 may be configured to reduce friction and/or wear between anchor element 512 and bit blade 110. For example, separation element may prevent wear and/or damage to front anchor surface 548 of anchor element 512 and/or anchor surface 515 of bit blade 110 resulting from movement (e.g., rotational movement) of anchor element 512 relative to bit blade 110. Separation element 516 may reduce frictional forces generated between anchor element 512 and bit blade 110 during movement of anchor element 512 relative to bit blade 110. By reducing the frictional forces, separation element 516 may facilitate rotation of the cutting element assembly (see, e.g., cutting element assembly 10 in FIG. 1) with respect to bit blade 110.

In an additional embodiment, separation element 516 may be positioned between biasing element 518 and bit blade 110, as shown in FIG. 36. Separation element 516 may be formed of a hard or wear resistant material configured to enable biasing element 518 to slide against separation element 516 during movement of biasing element 518. For example, biasing element 518 may experience rotational movement caused by the rotation of anchor element 512 relative to bit blade 110. As biasing element 518 rotates, it may move against the hard surface of separation element 516, thereby preventing wear and damage to biasing element 518 and/or bit blade 110. Likewise, separation element 516 may reduce frictional forces generated between biasing element 518 and bit blade 110 during movement of anchor element 512 relative to bit blade 110. Accordingly, separation element 516 and/or biasing element 518 may enable proper seating of the cutting element assembly in bit blade 110 while reducing frictional forces, thereby facilitating rotation of the cutting element assembly (see, e.g., cutting element assembly 10 in FIG. 1) with respect to bit blade 110

Figure 37A:
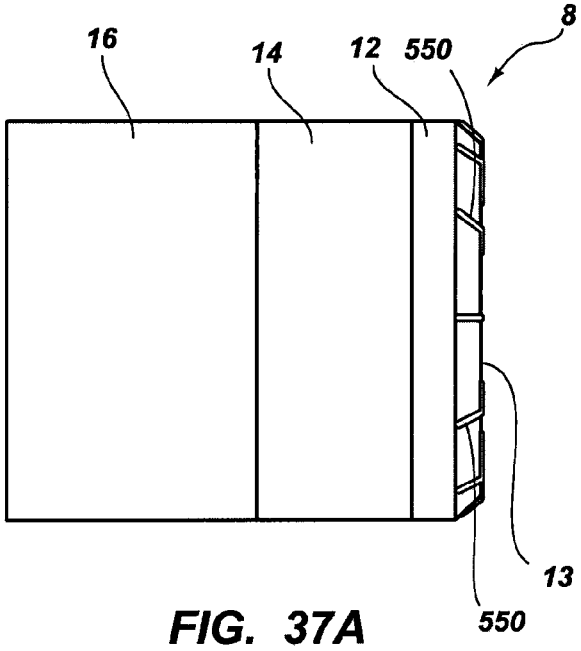
FIG. 37A shows a side view of a cutting element according to at least one embodiment.
Figure 37B:
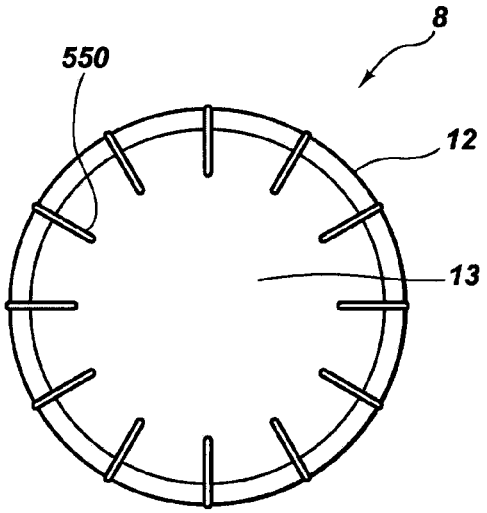
FIG. 37B shows a front view of the cutting element shown in FIG. 37A.

FIGS. 37A-40B show various geometries and/or patterns for cutting face 13. FIG. 37A is a side view of cutting element 8 comprising a cutting face 13 having cutting-face ridges 550. FIG. 37B is a front view of the cutting element 8 shown in FIG. 37A showing cutting face 13. As shown in FIGS. 37A and 37B, cutting face 13 may comprise one or more cutting-face ridges 550. Cutting-face ridges 550 may comprise any suitable protrusions. Cutting-face ridges 550 may also represent recessions defined in cutting face 13 of cutting element 8.

In at least one embodiment, cutting-face ridges 550 may extend to a circumferential edge portion of cutting face 13. Additionally, cutting-face ridges 550 may be formed to varying shapes and/or sizes. Cutting-face ridges 550 may encourage rotation of cutting element 8 when cutting face 13 contacts a formation during a drilling operation. For example, as bit blade 110 moves relative to a subterranean formation, cutting-face ridges 550 may contact and frictionally and/or mechanically engage portions of the subterranean formation. As cutting-face ridges 550 engage portions of the subterranean formation, cutting-face ridges 550 may cause cutting element 8 to rotate as bit blade 110 moves relative to the subterranean formation, and accordingly, relative to cutting-face ridges 550.

Figure 38:
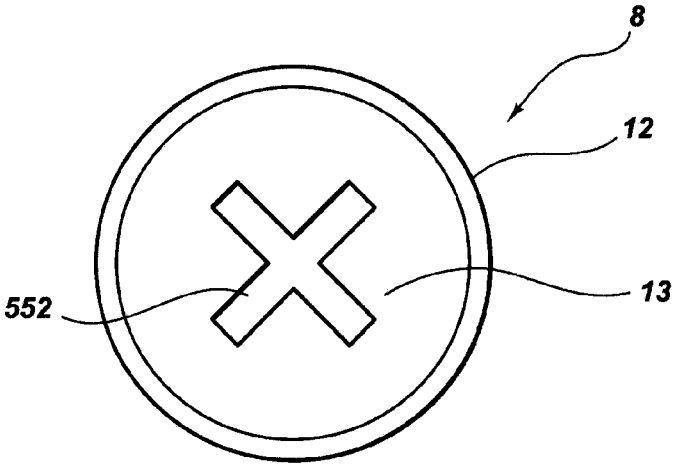
FIG. 38 shows a front view of a cutting-face on a table of a cutting element according to at least one embodiment.

FIG. 38 is a front view of a cutting face 13 having at least one slot 552. Slots 552 may be formed to accommodate any size and/or shape of screwdriver or any other suitable tightening instrument. Slots 552 may also be formed to varying depths in table 12. Slots 552 may be used to apply torque to cutting element 8 and structural element 70 when structural element 70 is fastened to cutting element 8. For example, structural element 70 may comprise a coupling portion 538 having a threaded configuration for coupling to a corresponding threaded coupling recess 536 defined in base member 16 (see, e.g., FIGS. 34 and 35). A force may be applied to structural element 70 to rotate coupling portion 538 into coupling recess 536. In order to provide a torque or moment countering the rotation of structural element 70, a screwdriver or other tightening instrument may be inserted into slots 552 and a torque or moment may be applied to slots 552 to maintain cutting element 8 and base member 16 stationary, or to cause cutting element 8 and base member 16 to rotate in a direction opposite that of rotating structural element 70. Additionally, slots 552 may be used to assist in detaching structural element 70 from base member 16.

Figure 39A:
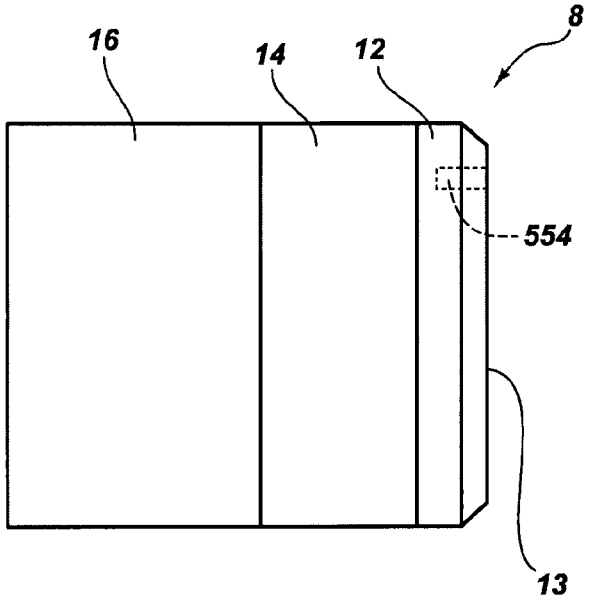
FIG. 39A shows a side view of a cutting element according to at least one embodiment.
Figure 39B:
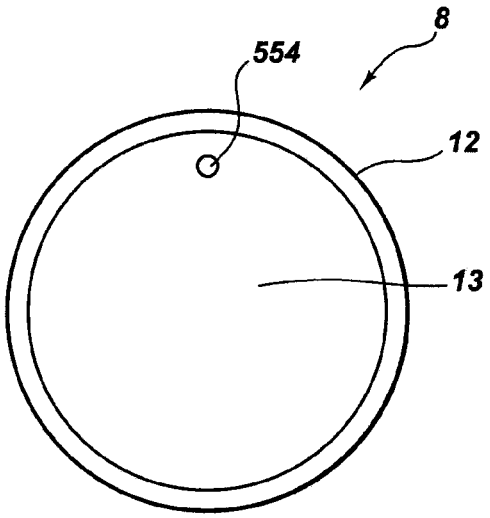
FIG. 39B shows a front view of the cutting element shown in FIG. 39A.

FIG. 39A is a side view of a cutting element 8 comprising a cutting face 13 having at least one cutting-face hole 554. FIG. 39B is a front view of the cutting element 8 shown in FIG. 39A. Cutting-face hole 554 may comprise a hole defined in cutting face 13 of cutting element 8. Cutting-face hole 554 may be formed to varying shapes and/or sizes. For example, cutting-face hole 554 may be cylindrically-shaped or slot-shaped, among others. In certain embodiments, cutting-face hole 554 may be used to apply torque to cutting element 8 and a structural element, such as structural element 70 in FIGS. 16A-16C, fastened to cutting element 8. For example, a structural element, such as structural element 70, may comprise a coupling portion, such as coupling portion 538 in FIG. 32, having a threaded configuration for coupling to a corresponding threaded coupling recess defined in a base member, such as recess 536 in base member 16 in FIGS. 34 and 35. In this example, torque may be applied to structural element 70 to rotate coupling portion 538 into coupling recess 536. In order to provide torque countering the rotation of structural element 70, a suitable instrument may be inserted into cutting-face hole 554 and a force may be applied to the instrument to maintain cutting element 8 and base member 16 stationary as structural element 70 rotates, or to cause cutting element 8 and base member 16 to rotate in a direction opposite that of structural element 70 as it rotates. Additionally, cutting-face hole 554 may be used to assist in detaching structural element 70 from base member 16.

Figure 40A:
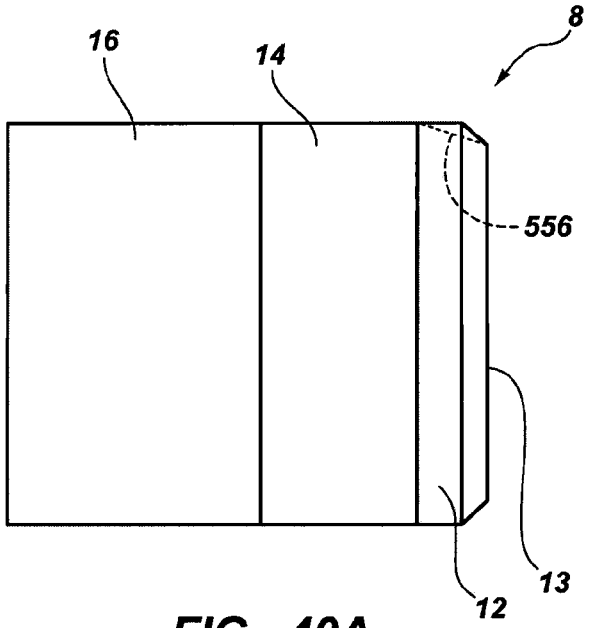
FIG. 40A shows a side view of a cutting element according to at least one embodiment.
Figure 40B:
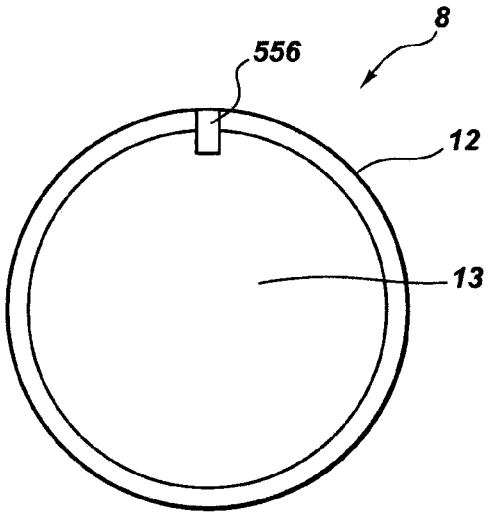
FIG. 40B shows a front view of the cutting element shown in FIG. 40A.

FIG. 40A is a side view of a cutting element 8 comprising a cutting face 13 having at least one cutting-face notch 556. FIG. 40B is a front view of the cutting element 8 shown in FIG. 40A. Cutting-face notch 556 may comprise a notch defined in cutting face 13 of cutting element 8. In at least one embodiment, cutting-face notch 556 may extend to a circumferential edge portion of cutting face 13 and/or to substrate 14. Additionally, cutting-face notch 556 may be formed to varying shapes and/or sizes. In various embodiments, cutting-face notch 556 may comprise an angled notch formed at a suitable angle relative to cutting face 13.

As with cutting-face hole 554 in FIG. 39A, cutting-face notch 556 may be used to apply torque to cutting element 8 when a structural element (such as structural element 70 in FIGS. 16A-16C) is fastened to cutting element 8. For example, structural element 70 may comprise a coupling portion 538 having a threaded configuration for coupling to a corresponding threaded coupling recess defined in a base member (such as recess 536 in base member 16 in FIGS. 34 and 35). Torque may be applied to structural element 70 to rotate coupling portion 538 into coupling recess 536. In order to provide torque countering the rotation of structural element 70, a suitable instrument may be inserted into cutting-face notch 556 and torque may be applied to the instrument to maintain cutting element 8 and base member 16 stationary as structural element 70 rotates, or to cause cutting element 8 and base member 16 to rotate in a direction opposite that of structural element 70 as it rotates. Additionally, cutting-face notch 556 may be used to assist in detaching structural element 70 from base member 16.

While certain embodiments and details have been included herein and in the attached invention disclosure for purposes of illustrating the invention, it will be apparent to those skilled in the art that various changes in the methods and apparatus disclosed herein may be made without departing form the scope of the invention, which is defined in the appended claims. The words "including" and "having," as used herein, including the claims, shall have the same meaning as the word "comprising."

What is claimed is:

1. A rotary drill bit for drilling a subterranean formation, comprising:

a bit body;

a cutting pocket defined in an exterior surface of the bit body;

a cutting element positioned at least partially in the cutting pocket, the cutting element comprising a substrate and a superabrasive material bonded to the substrate, the superabrasive material having a cutting face, a sidewall, a chamfer positioned between the cutting face and the side wall, and at least one surface feature comprising a ridge having at least a portion located on and protruding from the cutting face and at least another portion extending onto and protruding from the chamfer.

2. The rotary drill bit of claim 1, wherein the at least one surface feature includes a plurality of circumferentially spaced ridges.

3. The rotary drill bit of claim 2, wherein each of the plurality of ridges is arranged in a radial pattern with each ridge extending radially outward from a central location of the cutting face.

4. The rotary drill bit of claim 2, wherein the plurality of ridges are configured to effect rotation of the cutting element within the cutting pocket when they engage a subterranean formation.

5. The rotary drill bit of claim 1, wherein the substrate extends from an end surface to a back surface and wherein the drill bit further comprise a base member affixed to the back surface of the substrate.

6. The rotary drill bit of claim 5, wherein the base member comprises an internal recess.

7. The rotary dill bit of claim 6, further comprising a structural element coupled to the recess of the base member.

8. The rotary drill bit of claim 7, further comprising an inner member positioned within the recess.

9. The rotary drill bit of claim 5, further comprising a through hole defined in the bit body, the through hole extending between the cutting pocket and an anchor surface of the bit body, wherein a structural element is rotatably disposed in the through hole and coupled with the base member.

10. The rotary drill bit of claim 9, further comprising a biasing element positioned between the structural element and the bit body.

11. The rotary drill bit of claim 1, wherein the superabrasive material comprises polycrystalline diamond and wherein the substrate comprises cemented tungsten carbide.

12. The rotary drill bit of claim 11, wherein the coating material comprises at least one of copper and nickel.

13. The rotary drill bit of claim 1, further comprising a material coating adhered to at least a portion of a surface of the cutting pocket and the cutting element, wherein the material coating is positioned and configured to reduce frictional forces generated between the cutting element and the cutting pocket during movement of the cutting element relative to the cutting pocket.

14. A cutting element assembly for use on a fixed cutter rotary drill bit for forming a borehole in a subterranean formation, the cutting element assembly comprising:

a cutting element comprising a substrate and a superabrasive material bonded to the substrate, the superabrasive material having a cutting face, a sidewall, a chamfer positioned between the cutting face and the side wall, and at least one surface feature comprising a ridge having at least a portion located on and protruding from the cutting face and at least another portion extending onto and protruding from the chamfer;

a base member coupled with the substrate, the base being configured for rotatable coupling with a cutting pocket of a rotary drill bit.

15. The cutting element assembly of claim 14, further comprising a coating on a portion of at least one of the substrate and the base member, the coating being positioned and configured to reduce frictional forces generated between the cutting element and an associated cutting pocket of a rotary drill bit during movement of the cutting element relative to the cutting pocket.

16. The cutting element of claim 15, wherein the coating material comprises at least one of copper and nickel.

17. The cutting element of claim 14, wherein the at least one surface feature includes a plurality of circumferentially spaced ridges.

18. The cutting element of claim 17, wherein each of the plurality of ridges is arranged in a radial pattern with each ridge extending radially outward from a central location of the cutting face.

19. The cutting element of claim 14, wherein the at least one surface feature is configured to effect rotation of the cutting element within an associated pocket of a rotary drill bit when the at least one surface feature engages a subterranean formation.

* * * * *